US007433608B2

(12) United States Patent
Seto et al.

(10) Patent No.: US 7,433,608 B2
(45) Date of Patent: Oct. 7, 2008

(54) IMAGE FORMING DEVICE WITH AUTOMATIC POWER CUTOFF

(75) Inventors: Masanori Seto, Iwatsuki (JP); Yoshiaki Haginoya, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/000,896

(22) Filed: Dec. 2, 2004

(65) Prior Publication Data

US 2005/0265736 A1 Dec. 1, 2005

(30) Foreign Application Priority Data

May 26, 2004 (JP) ..... 2004-155947

(51) Int. Cl.
*G03G 15/00* (2006.01)
*G03G 15/08* (2006.01)

(52) U.S. Cl. ..... 399/13; 399/27

(58) Field of Classification Search ..... 399/13, 399/110, 111, 113, 119, 9, 25, 27
See application file for complete search history.

(56) References Cited

U.S. PATENT DOCUMENTS 5,909,603 A * 6/1999 Suzuki et al. ..... 399/13
6,714,224 B2 * 3/2004 Yamanaka et al. ..... 347/116
2001/0051051 A1 * 12/2001 Matsumoto ..... 399/13
2004/0008997 A1 * 1/2004 Yoshimoto ..... 399/13
2004/0120723 A1 * 6/2004 Ito ..... 399/12

FOREIGN PATENT DOCUMENTS

JP 4-190253 A 7/1992
JP 05-323714 * 7/1993
JP 5-323714 A 12/1993

* cited by examiner

*Primary Examiner*—Hoang Ngo
(74) *Attorney, Agent, or Firm*—Sughrue Mion, PLLC

(57) ABSTRACT

When a process cartridge is installed in a laser printer main body, a projecting rod, which is provided at a toner tank and which projects from a side surface of a housing of the cartridge, enters into a U-shaped positioning portion such that the cartridge is positioned. The projecting rod pushes a lever of a switch downward and turns the switch on. Operation of the printer becomes possible, and power is supplied to a light scanning device. Even if the cartridge, in which the toner tank is not installed, is installed in a laser printer, because the projecting rod does not project out, the process cartridge is not positioned, and the switch remains off. The printer does not operate and power is not supplied to the light scanning device.

20 Claims, 20 Drawing Sheets

IMAGE FORMING DEVICE WITH AUTOMATIC POWER CUTOFF

CROSS-REFERENCE TO RELATED APPLICATION

This application claims priority under 35 USC 119 from Japanese Patent Application No. 2004-155947, the disclosure of which is incorporated by reference herein.

BACKGROUND OF THE INVENTION

1. Field of the Invention

The present invention relates to an image forming device.

2. Description of the Related Art

A latent image is formed on a photosensitive body by laser light emitted from a light scanning device. The latent image is developed by a developing device, such that a toner image is formed on the photosensitive body. Image forming devices using a known electrophotographic process are known which record an image by transferring the toner image formed on the photosensitive body onto a recording sheet or the like, and then fix the transferred toner image to the recording sheet.

A charging device, the developing device, a toner tank, a cleaning device, and the like, together with the photosensitive body, form an integral process cartridge. There are image forming devices which are structured such that the process cartridge can be installed in and removed from the image forming device.

Such an image forming device has a mechanism which permits operation of the image forming device in accordance with the installation/removal of the process cartridge.

Further, there are image forming devices in which, when the process cartridge is removed, the input of power to the light scanning device is electrically cut so that laser light is not irradiated, in order for laser light to not leak out to the exterior. (See, for example, Japanese Patent Application Laid-Open (JP-A) No. 5-323714.)

Moreover, there are image forming devices in which, in order for laser light to not leak out to the exterior, the side in the direction opposite the direction in which the laser light of the light scanning device exits, is the side in the direction of installing and removing the process cartridge, and the inner wall surface of the image forming device to which the laser light is irradiated is a scattering reflecting surface. (See, for example, JP-A No. 4-190253.)

However, recently, process cartridges are being used in which the toner tank can be installed/removed from the process cartridge, and only the toner tank is replaced.

Even if a mechanism is provided which permits operation of the image forming device in accordance with the installation/removal of the process cartridge, the image forming device can be operated even if the user installs the process cartridge in a state of having forgotten to install the toner tank therein.

Thus, there is a complete lack of toner, and blank sheets are outputted. Or, in the case of a developing system utilizing a developing agent in which toner and carrier are mixed together, the lack of toner causes problems such as the carrier damages the photosensitive body, or, after the carrier adheres to the photosensitive body, the carrier is transferred to the recording sheet and carried to the fixing device where it damages the rollers of the fixing device, or the like.

In the structure disclosed in JP-A No. 4-190253, because the laser light optical path itself is not blocked, if the operator takes a look inside the device, he/she can directly see the laser light.

SUMMARY OF THE INVENTION

According to an aspect of the present invention, there is provided an image forming device comprising: a device main body; a cartridge attached removably to the device main body, the cartridge having a cartridge housing, a photosensitive body, a developing section for developing a latent image formed on the photosensitive body, and a developing agent tank accommodated in the cartridge housing and for supplying developing agent to the developing section; an indication portion provided at the developing agent tank; a sensing portion sensing the indication portion; and a permitting portion permitting operation of the image forming device when the sensing portion senses the indication portion.

BRIEF DESCRIPTION OF THE DRAWINGS

Preferred embodiments of the invention will be described in detail based on the following figures, wherein:

FIG. 8A shows a state before installation of the process cartridge, and FIG. 8B shows a state in which the process cartridge is installed and positioned with respect to a laser printer main body, and a switch is turned on;

FIG. 11A shows a state before installation of the process cartridge, and FIG. 11B shows a state in which the process cartridge is installed and positioned with respect to a laser printer main body, and a switch is turned on;

FIG. 16B is a view seen from direction b in FIG. 16A, and FIG. 16C is a view seen from direction c in FIG. 16A;

DETAILED DESCRIPTION OF THE INVENTION

Hereinafter, a laser printer, to which a known electrophotographic process is applied, will be described with reference to the figures as an example of application of an image forming device relating to the present invention. The known electrophotographic process is the series of processes in which a toner image, which is formed on a photosensitive body by the processes of charging the photosensitive body, forming a latent image by exposure by a laser or the like, and developing the latent image by a toner, is transferred onto a recording sheet or the like, the toner image is fixed to the recording sheet, and an image is thereby recorded.

The image forming device to which the present invention is applied is not limited to the laser printer which will be described hereinafter, and may be a copier, a fax machine, a multifunction device, or the like.

First, a first embodiment of the present invention will be described.

Figure 1:
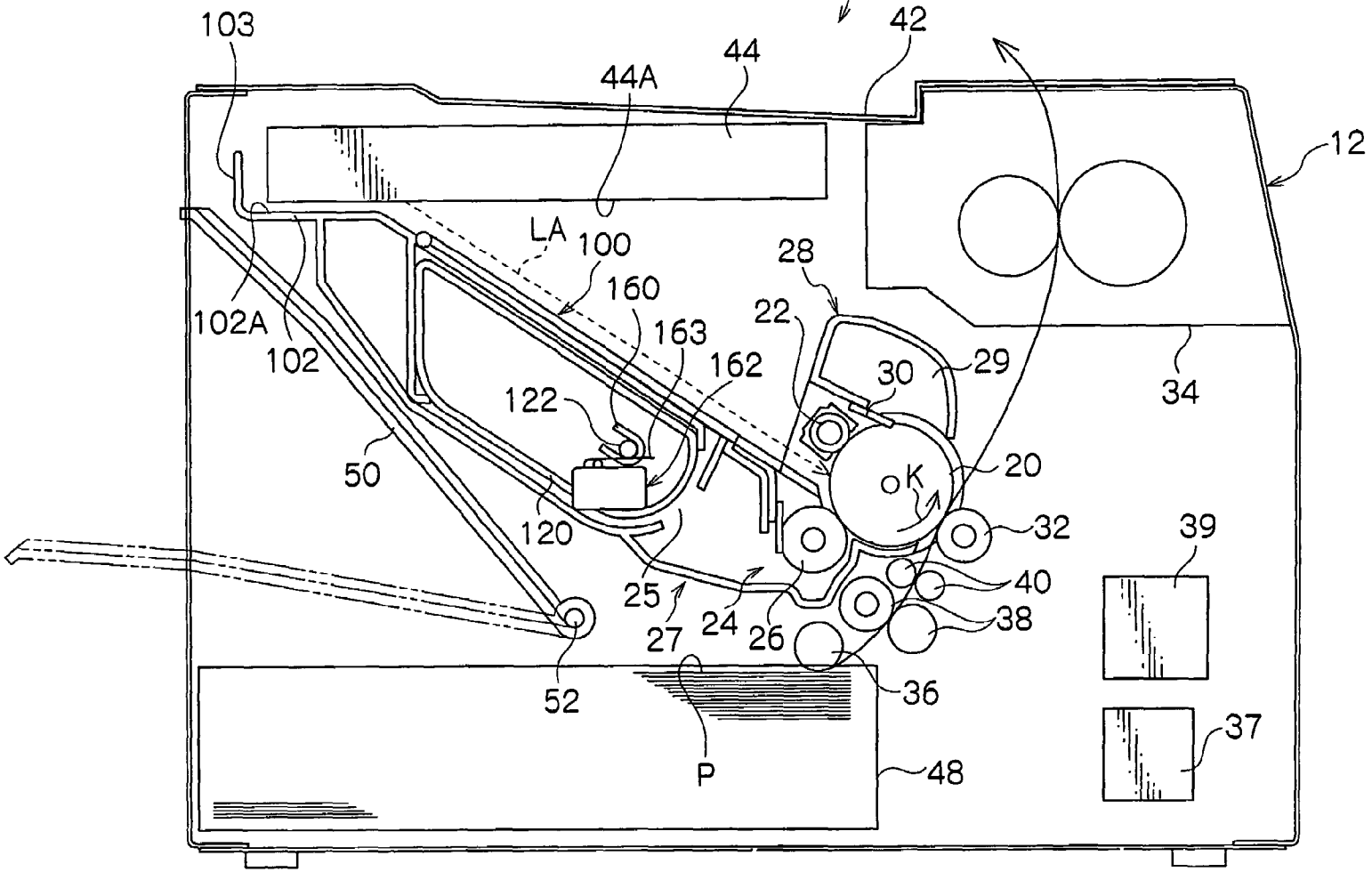
FIG. 1 is a drawing schematically illustrating the interior of a laser printer relating to a first embodiment of the present invention.

The schematic structure of a laser printer 11 is shown in FIG. 1. By the above-described known electrophotographic process, the laser printer 11 forms a toner image on the basis of image information inputted from an external device, and records the image onto a recording sheet P. Note that, in the following explanation, detailed description of structures which are not directly related to the fundamentals of the present invention will be omitted.

A summary of the structure of the laser printer 11 and a summary of the processes for forming an image on the recording sheet P will be described first. Note that, in the drawings, the left side is the front surface side.

As shown in FIG. 1, a photosensitive drum 20 is disposed rotatably in a vicinity of the center of the interior of the laser printer 11. The photosensitive drum 20 is rotated in the direction of arrow K by a driving device (not illustrated).

A roller charging device 22 is disposed so as to contact the upper left portion of the photosensitive drum 20. The roller charging device 22 applies a charging bias so as to charge the photosensitive drum 20 to a predetermined potential. After charging, exposure is carried out by laser light LA emitted from a light scanning device 44 disposed above the photosensitive drum 20, and a latent image corresponding to the image information is formed on the surface of the photosensitive drum 20.

A developing device 27 is structured by a developing section 24, which has a developing roller 26 carrying toner which has been charged to a predetermined polarity, and a toner tank 120, which accommodates toner to be supplied to the developing section 24.

Due to developing bias being applied by the developing roller 26, the latent image formed on the surface of the photosensitive drum 20 is developed such that a toner image is formed. The toner image is conveyed to a nip portion between the photosensitive drum 20 and a transfer roller 32.

A sheet feed cassette 48 accommodating the recording sheets P is disposed at the lower portion of the laser printer 11. The recording sheet P is fed-out by a pick-up roller 36 and conveyed by conveying rollers 38. At a predetermined timing, the recording sheet P is fed by resist rollers 40 to the nip portion between the transfer roller 32 and the photosensitive drum 20.

Voltage, which is of a polarity opposite that of the aforementioned predetermined potential of the toner, is applied to the transfer roller 32, and the toner image of the photosensitive drum 20 is transferred onto the recording sheet P. The recording sheet P, to which the toner image has been transferred, is sent to a fixing device 34. The fixing device 34 fixes the toner image to the recording sheet P by heat and pressure. The recording sheet P to which the toner image is fixed is discharged out onto a sheet discharge tray 42 at the top portion of the laser printer 11.

The toner image is not completely transferred onto the recording sheet P by the transfer roller 32, and a portion of the toner image remains on the photosensitive drum 20 as residual toner. The residual toner is scraped off by a cleaning blade 30 of a cleaning device 28, and is recovered in an interior 29 of the cleaning device 28.

A control section 39 which controls the respective portions of the laser printer 11 is provided in the laser printer 11. Further, the laser printer 11 has a power source section 37 which supplies power to the respective portions.

The photosensitive drum 20, the developing device 27, the cleaning device 28, and the roller charging device 22 are integral, and structure a process cartridge 100. The process cartridge 100 is removably installed in a laser printer main body 12.

A light blocking wall 103 stands erect at the rear end portion (the left side in FIG. 1) of a housing 102 of the process cartridge 100. The light blocking wall 103 is higher than a bottom surface 44A of the light scanning device 44, in which bottom surface 44A is formed a light exiting opening through which the laser light LA exits. Note that the front/rear directions of the laser printer 11 and the process cartridge 100 are opposite to one another.

Figure 2:
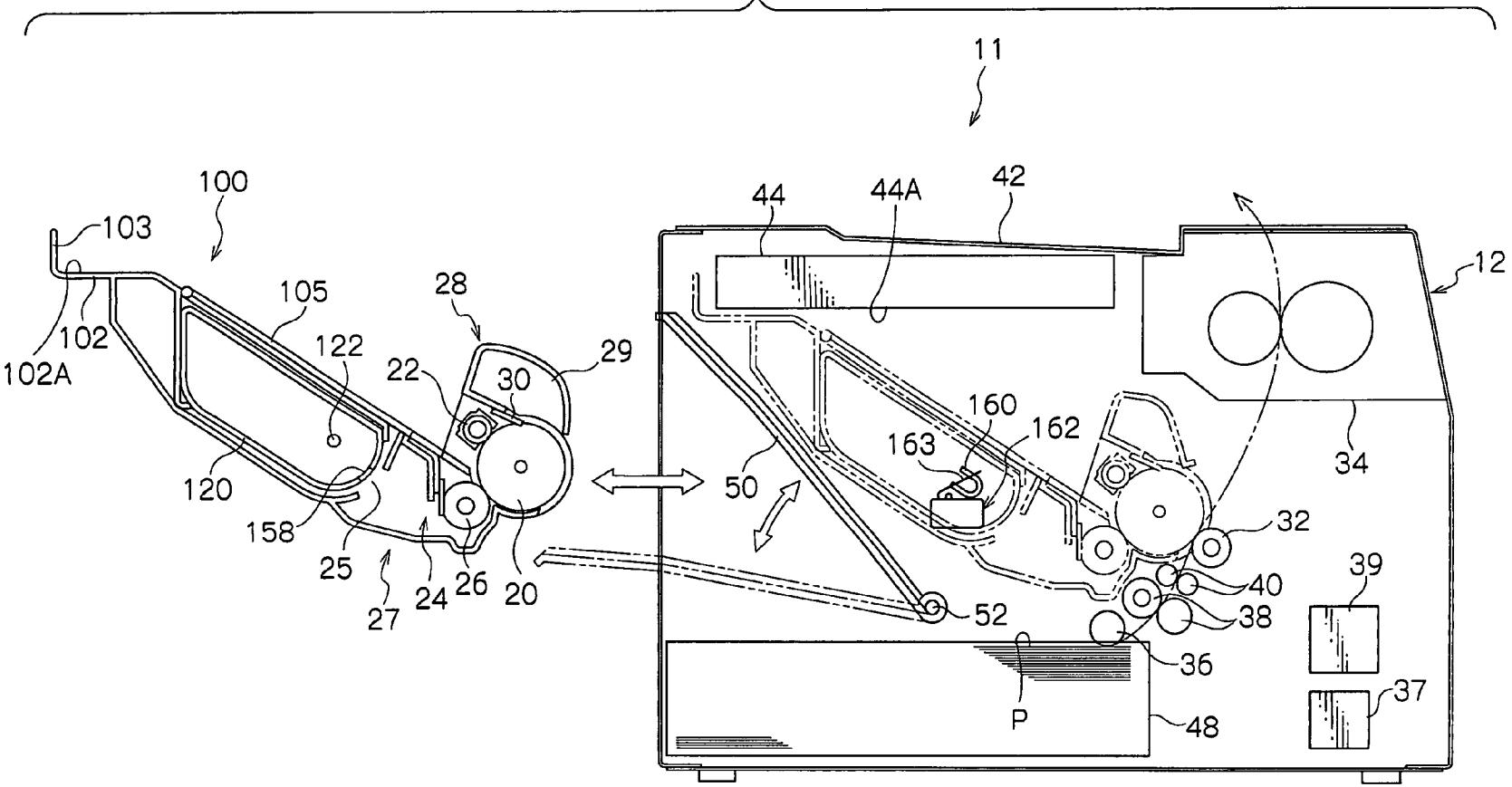
FIG. 2 is a drawing showing a state of removing/installing a process cartridge.

An opening/closing cover 50 for installation and removal of the process cartridge 100 is provided at the front surface portion of the laser printer 11. The opening/closing cover 50 opens and closes around a rotating shaft 52 which is at the lower end portion thereof. As shown in FIG. 2, the opening/closing cover 50 is opened, and the process cartridge 100 can be installed and removed.

Figure 3:
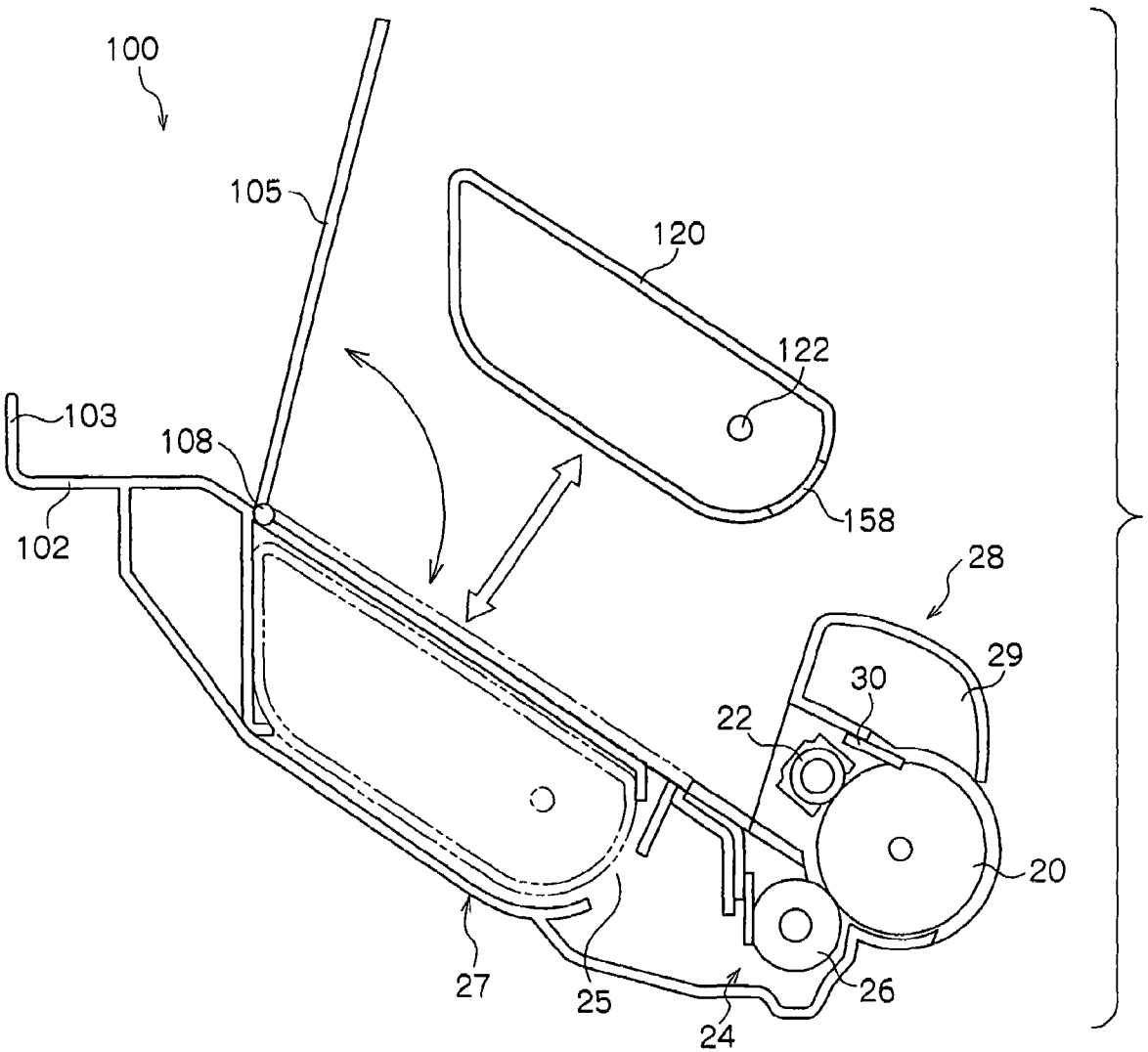
FIG. 3 is a drawing showing a state of removing/installing a toner tank from and into the process cartridge.

The direction of installation/removal of the process cartridge 100 is at the side opposite the exposure direction of the laser light LA exiting from the light scanning device 44. (As shown in FIGS. 1 and 2, the exposure direction of the laser light LA is the rightward direction, and the direction of installation/removal of the process cartridge 100 is the leftward direction.) As shown in FIG. 3, a cover portion 105 at the top surface of the process cartridge 100 opens and closes around a rotating shaft 108 which is at the rear end portion thereof. The cover portion 105 is opened, and it is possible to replace only the toner tank 120. The cover portion 105 is fixed in its closed state by an unillustrated locking mechanism.

A rectangular toner supply opening 158, which is long in the longitudinal direction, is formed in the front surface portion of the toner tank 120. Toner is replenished to the developing section 24 from this toner supply opening 158.

Figure 7C:
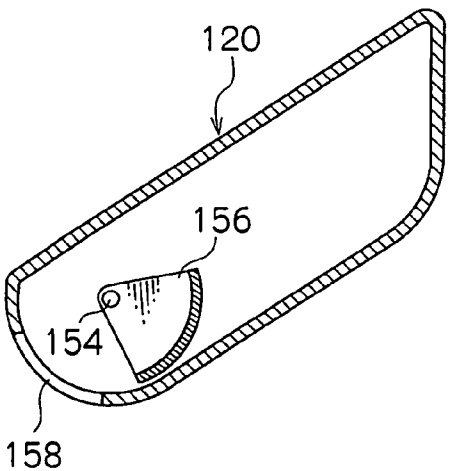
FIGS. 7A, 7B, and 7C are drawings showing, in order, states of a shutter within the toner tank opening.
Figure 7B:
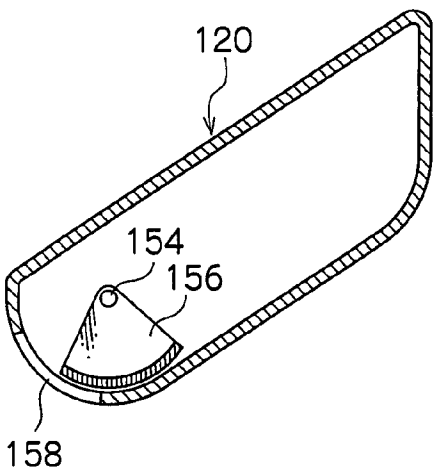
Figure 7A:
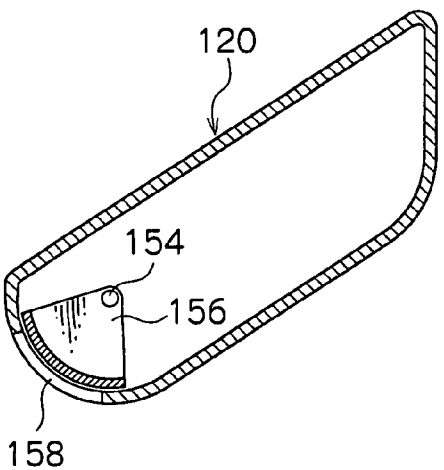

As shown in FIGS. 7A through 7C, a shutter 156 is provided within the toner tank 120. The shutter 156 rotates around a rotating shaft 154 so as to open and close the toner supply opening 158.

Figure 6A:
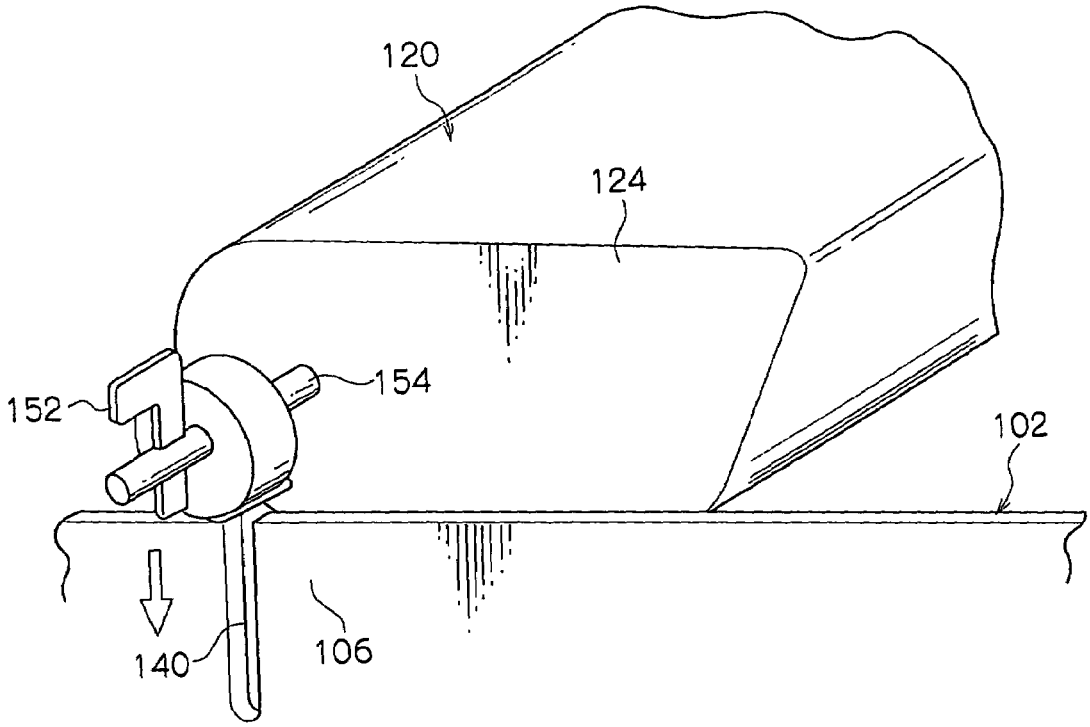
FIGS. 6A and 6B are drawings showing, in order, states of installing the toner tank in the process cartridge and rotating a lever.
Figure 6B:
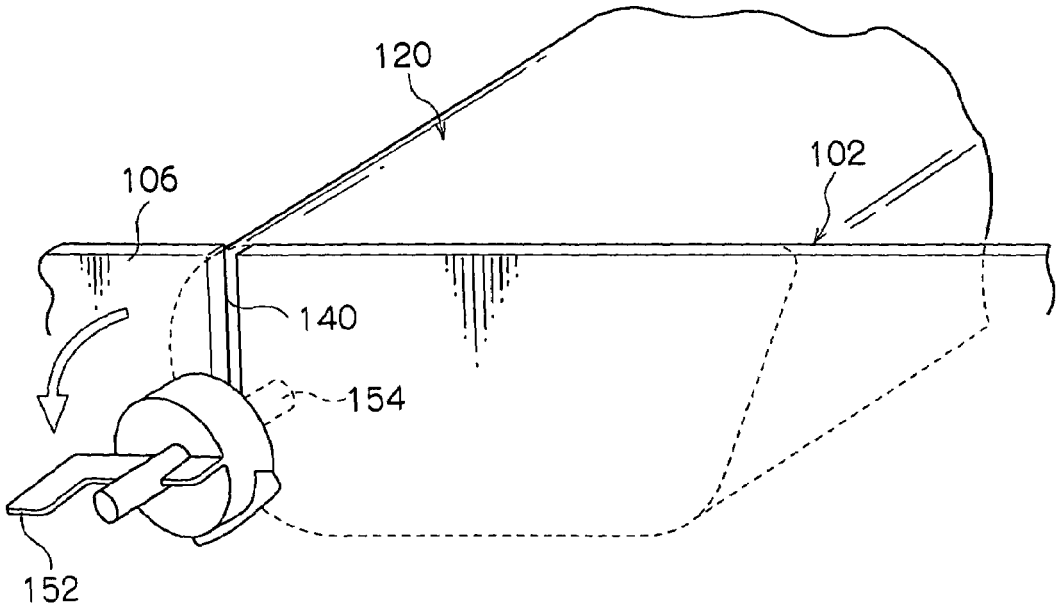

As shown in FIGS. 6A and 6B, one end portion of the rotating shaft 154 projects outwardly of one side surface 124 of the toner tank 120. (This is at the far side in FIGS. 1, 2 and 3, and is therefore not illustrated in FIGS. 1, 2 and 3.) A lever 152 is attached to the rotating shaft 154 which projects out.

Figure 4A:
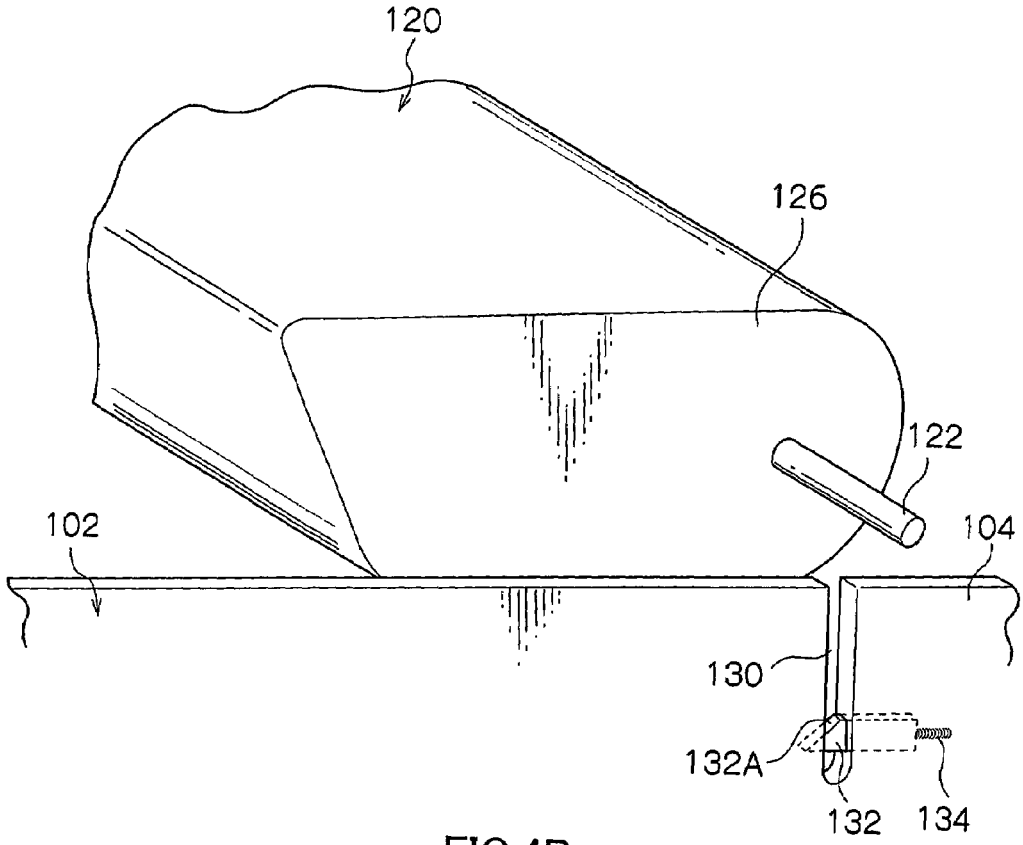
FIGS. 4A and 4B are drawings showing, in order, states of installing the toner tank in the process cartridge relating to the first embodiment of the present invention.
Figure 4B:
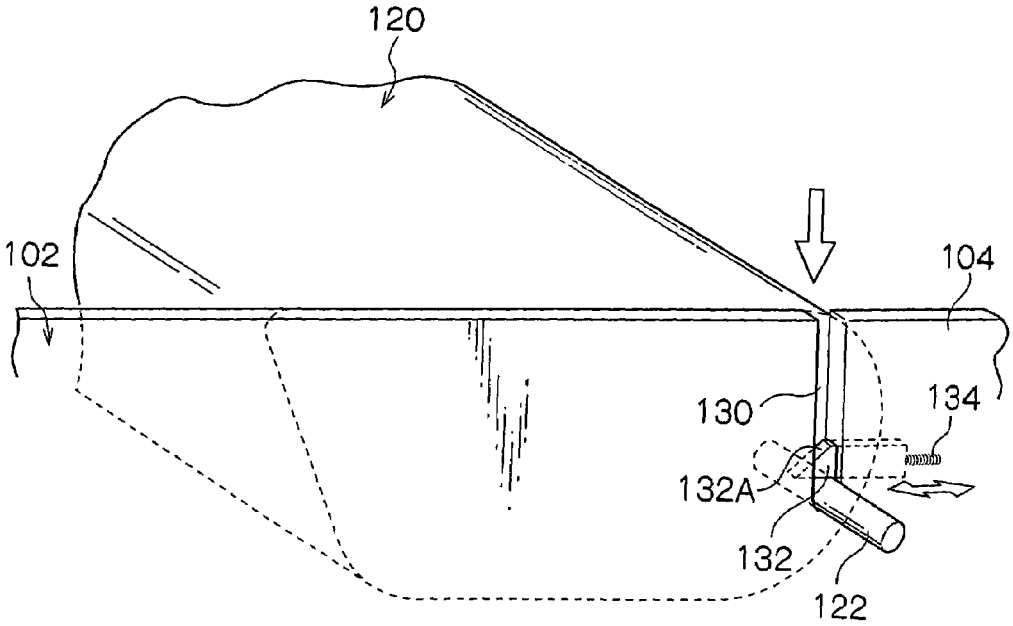

As shown in FIGS. 4A and 4B, a bar-shaped projecting rod 122 projects at another side surface 126 of the toner tank 120 (the side surface at the near side in FIGS. 1, 2 and 3).

As shown in FIGS. 4A and 4B, and FIGS. 6A and 6B, engaging grooves 130, 140 are formed in side surfaces 104, 106 of the housing 102 of the process cartridge 100. The projecting rod 122 and the rotating shaft 154 fit into these engaging grooves 130, 140.

As shown in FIG. 6B, in the state in which the rotating shaft 154 is fit in the engaging groove 140, the lever 152 attached to the rotating shaft 154 is positioned at the outer side of the side surface 106 of the housing 102 of the process cartridge 100.

As shown in FIGS. 4A and 4B, the engaging groove 130 of the other side surface 104, into which the projecting rod 122 is fit, is opened and closed by a lock plate 132 which can slide in the direction orthogonal to the groove direction of the engaging groove 130. The lock plate 132 is urged by a spring 134 in the direction of closing the engaging groove 130. An inclined portion 132A is formed at the end portion of the lock plate 132.

Accordingly, as shown in FIG. 4B, when the projecting rod 122 is inserted into the engaging groove 130 from above, the projecting rod 122 abuts the inclined portion 132A, and thereafter, when the projecting rod 122 is pushed further downward, force sliding the lock plate 132 toward the right is generated, and the lock plate 132 slides against the urging force of the spring 134 and opens. Accordingly, the projecting rod 122 enters in beneath the lock plate 132. When the projecting rod 122 enters in beneath the lock plate 132, the lock plate 132 is slid by the urging force of the spring 134 and closes. Accordingly, the projecting rod 122 is locked such that it cannot be pulled-out upwardly.

Figure 5A:
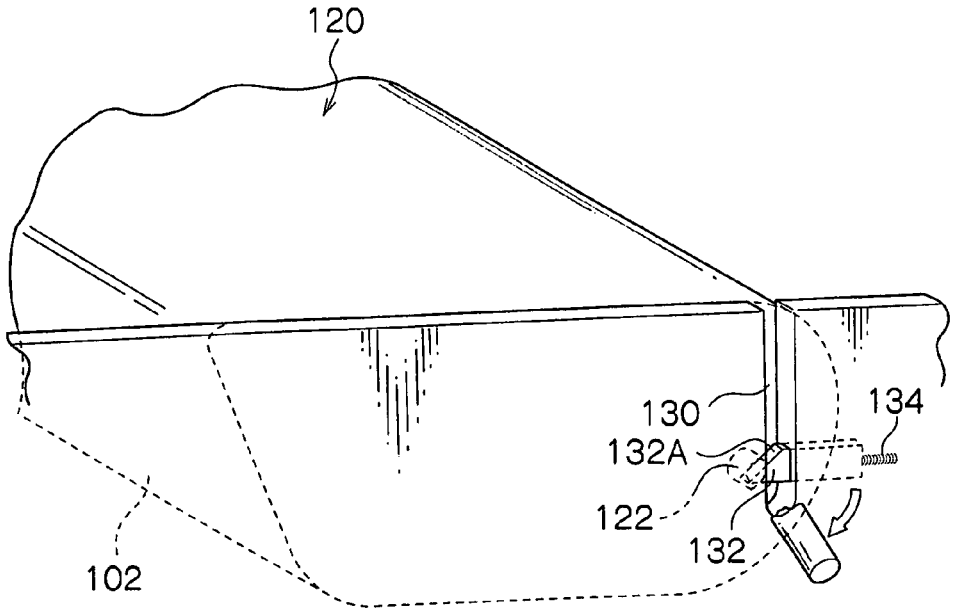
FIGS. 5A and 5B are drawings showing, in order, states of removing the toner tank from the process cartridge relating to the first embodiment of the present invention.
Figure 5B:
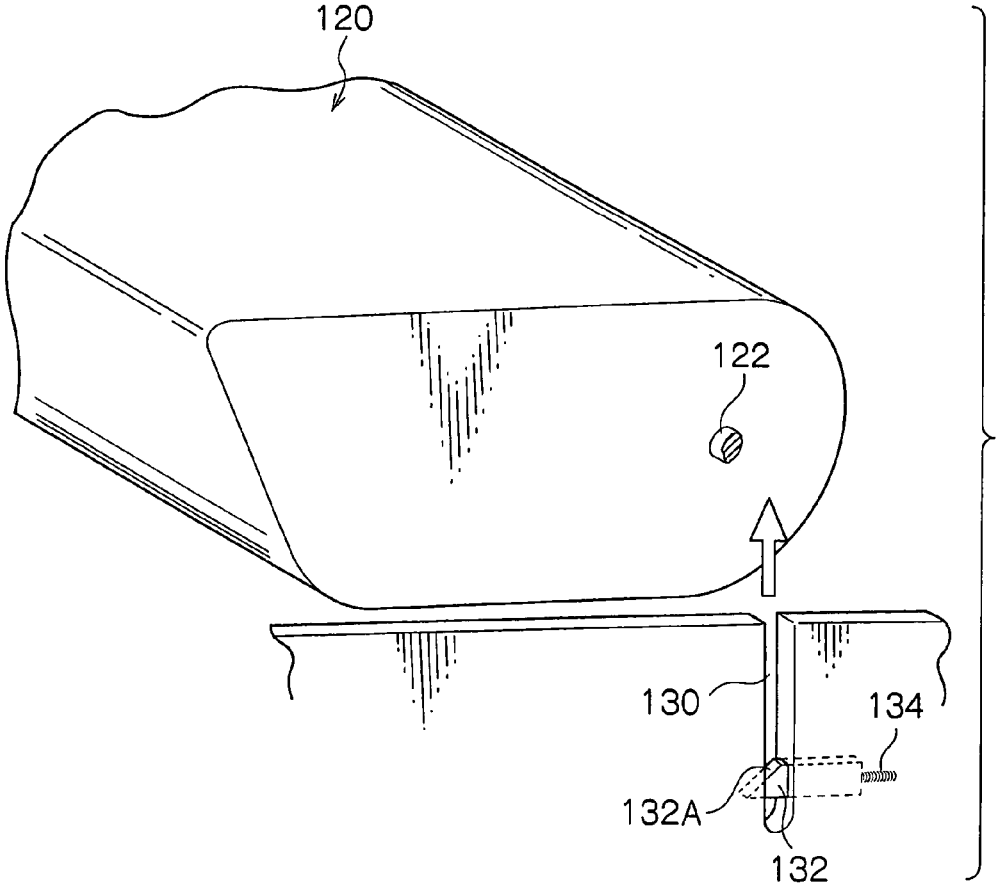

Accordingly, when the toner tank 120 is to be removed from the process cartridge 100, as shown in FIGS. 5A and 5B, the projecting rod 122 is broken off from the root portion thereof. Then, the toner tank 120 is removed.

As described above, the toner supply opening 150 is open at the front side portion of the toner tank 120. As shown in FIG. 7A, when the toner tank 120 is installed, the shutter 156 is closed. Accordingly, the lever 152 is rotated as shown in FIG. 6B, and the shutter 156 is opened as shown in FIGS. 7B and 7C. When the shutter 156 opens, the toner supply opening 158 of the toner tank 120 and a toner replenishing opening 25 (see FIG. 3) of the developing section 24 communicate with one another, such that toner can be supplied from the toner tank 120 to the developing section 24. Note that the gap between the surface in which the toner supply opening 158 is formed and the surface in which the toner replenishing opening 25 is formed is sealed by an unillustrated sealing member such as a sponge or the like, such that toner does not leak out from the gap.

Figure 8A:
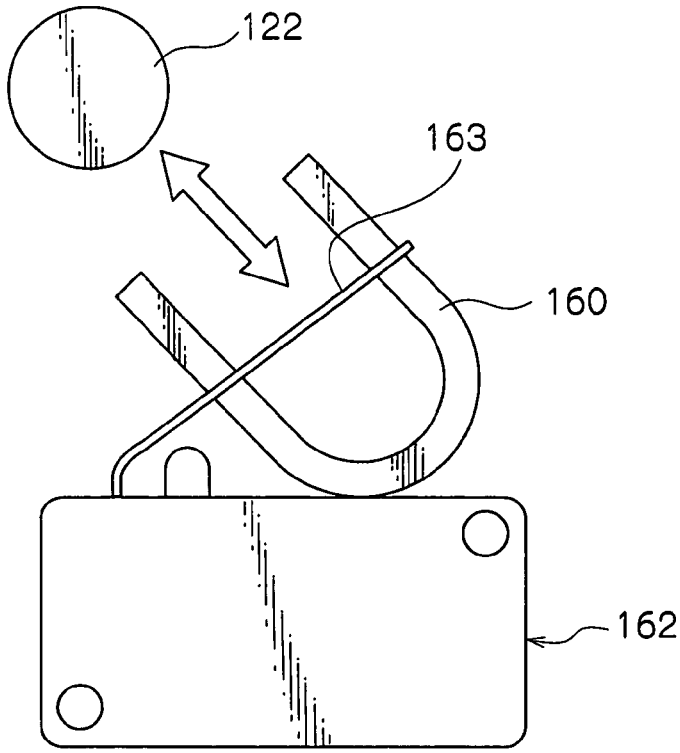
FIGS. 8A and 8B are drawings relating to the first embodiment of the present invention, where
Figure 8B:
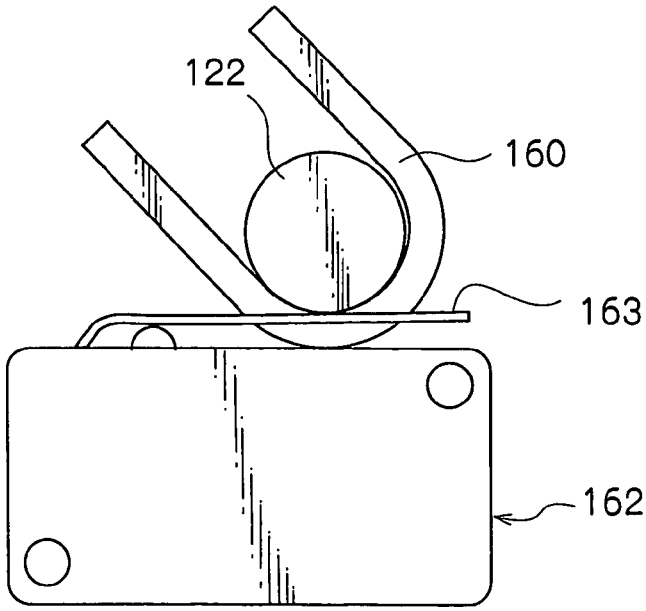

As shown in FIGS. 1 and 8B, when the process cartridge 100 is installed in the laser printer main body 12, the projecting rod 122 which projects from the side surface 104 of the housing 102 of the process cartridge 100 (see FIGS. 4A and 4B), and the rotating shaft 154 which projects from the side surface 106 (see FIGS. 6A and 6B), enter into U-shaped positioning portions 160 such that the process cartridge 100 is positioned. Note that, although only the positioning portion 160 at the near side in the drawings is illustrated in FIGS. 1 and 8B, the positioning portion 160 into which the rotating shaft 154 enters (see FIGS. 6A and 6B) is provided at the far side as well.

A switch 162 is provided only at the projecting rod 122 side. The projecting rod 122 pushes a lever 163 of the switch 162 downward so as to turn the switch 162 on. However, as shown in FIGS. 2 and 8A, when the process cartridge 100 is not installed, the lever 163 is not pushed down by the projecting rod 122, and therefore, the switch 162 is off. The switch 162 is connected to the control section 39. When the switch 162 is on, the control section 39 permits operation of the laser printer 11.

The switch 162 is attached to a power source line which supplies power from the power source section 37 to the light scanning device 44. When the switch 162 is on, the power source line is connected, and power is supplied to the light scanning device 44. However, when the switch 162 is off, the power source line is cut-off, and power is not supplied to the light scanning device 44. Namely, the switch 162 also functions as a power supply permitting device of the light scanning device 44.

Next, operation of the first embodiment will be described.

As the formation of images onto the recording sheets P is carried out, the toner in the toner tank 120 of the process cartridge 100 is consumed, and the amount thereof decreases. The amount of toner decreases, and when the remaining amount of the toner is a predetermined amount or less, an operation panel (not shown) or the like displays the fact that the toner is low. The user opens the opening/closing cover 50 as shown in FIG. 2, and removes the process cartridge 100.

Although the toner in the toner tank 120 of the process cartridge 100 is low, the other parts such as the photosensitive drum 20 and the like are still usable. Therefore, only the toner tank 120 of the process cartridge 100 is replaced.

The way of replacing the toner tank 120 will be described hereinafter.

As shown in FIG. 3, the user opens the cover portion 105 of the process cartridge 100. As shown in FIG. 4B, the projecting rod 122 catches on the lock plate 132 such that the toner tank 120 cannot be pulled-out upwardly. Accordingly, as shown in FIG. 5A, the projecting rod 122 is broken from the root portion thereof, and as shown in FIG. 5B, the toner tank 120 is removed and a new toner tank 120 is installed. (Installation has been described previously.) When replacement of the toner tank 120 is completed, the user closes the cover portion 105 and rotates the lever 152 as shown in FIG. 6B, and the shutter 156 opens 156 as shown in FIGS. 7B and 7C.

When replacement of the toner tank 120 is completed, as shown in FIGS. 1 and 8B, the process cartridge 100 is installed in the laser printer main body 12.

Note that the process cartridge 100 can be installed in the laser printer main body 12 with the lever 152 at its rotated position shown in FIG. 6B, i.e., with the lever 152 positioned such that the shutter 156 is open. However, when the lever 152 is at the position of not having been rotated as shown in FIG.

6A, i.e., when the lever 152 at the position at which the shutter 156 is closed, the lever 152 catches on an unillustrated member provided at the interior of the laser printer 11 such that the process cartridge 100 cannot be installed in the laser printer main body 12.

When the process cartridge 100 is installed in the laser printer main body 12, the projecting rod 122 and the rotating shaft 154, which project from the side surfaces 104, 106 of the housing 102 of the process cartridge 100, enter into the U-shaped positioning portions 160 such that the process cartridge 100 is positioned. Further, the projecting rod 122 pushes the lever 163 of the switch 162 downward and turns the switch 162 on. Accordingly, operation of the laser printer 11 is possible, and power is supplied to the light scanning device 44.

If the user forgets to install the toner tank 120 in the process cartridge 100, the switch 162 does not sense the projecting rod 122 because the projecting rod 122 is not projecting out. Therefore, the laser printer 11 does not operate. Accordingly, problems caused by the toner tank 120 not being installed, such as, for example, being completely out of toner and printing not being carried out (blank sheets being outputted), do not arise.

Because power is not supplied to the light scanning device 44, the laser light LA does not carry out exposure.

Further, because the projecting rod 122 is not set in the positioning portion 160, the process cartridge 100 is not positioned. Therefore, the laser printer 11 does not operate normally. In addition, the user will notice right away that he/she forgot to install the toner tank 120.

As shown in FIGS. 5A and 5B, the projecting rod 122 must be broken in order for the toner tank 120 to be removed. Accordingly, even if a toner tank 120 which had previously been removed is mistakenly installed again in the process cartridge 100, that toner tank 120 cannot be fixed to the process cartridge 100.

Even if the process cartridge 100 is installed in the laser printer main body 12 with the toner tank 120 not fixed to the process cartridge 100, the projecting rod 122 does not project out, and therefore, the switch 162 does not sense the projecting rod 122. Accordingly, the laser printer 11 does not operate, and power is not supplied to the light scanning device 44. Further, normal positioning is not carried out.

As shown in FIG. 1, the exposure direction of the laser light LA is at the side in the same direction as the direction of installing the process cartridge 100 (see FIG. 2). Accordingly, even if, for some reason, the laser light of the light scanning device 44 does exit, the exposure direction of the laser light LA is at the side opposite the direction of removing the process cartridge 100. Therefore, when the process cartridge 100 is removed, the laser light LA is not directed toward the opening/closing cover 50 side (the open side).

When the process cartridge 100, in which the toner tank 120 is installed, is installed in the laser printer main body 12, the laser printer 11 can operate, power is supplied to the light scanning device 44, and the laser light LA can be irradiated. However, the light blocking wall 103, which is higher than the gap between a top surface 102A of the process cartridge 100 and the bottom surface 44A of the light scanning device 44, stands erect at the rear end portion (the left side in FIG. 1) of the process cartridge 100. Accordingly, even if the laser light LA is emitted in the state in which the opening/closing cover 50 is open, the reflected light of the laser light LA is blocked by the light blocking wall 103 and does not leak out.

The laser printer 11 may be used as the printer engine in another image forming device such as, for example, a copier, a fax machine, a multifunction device, or the like.

Figure 20:
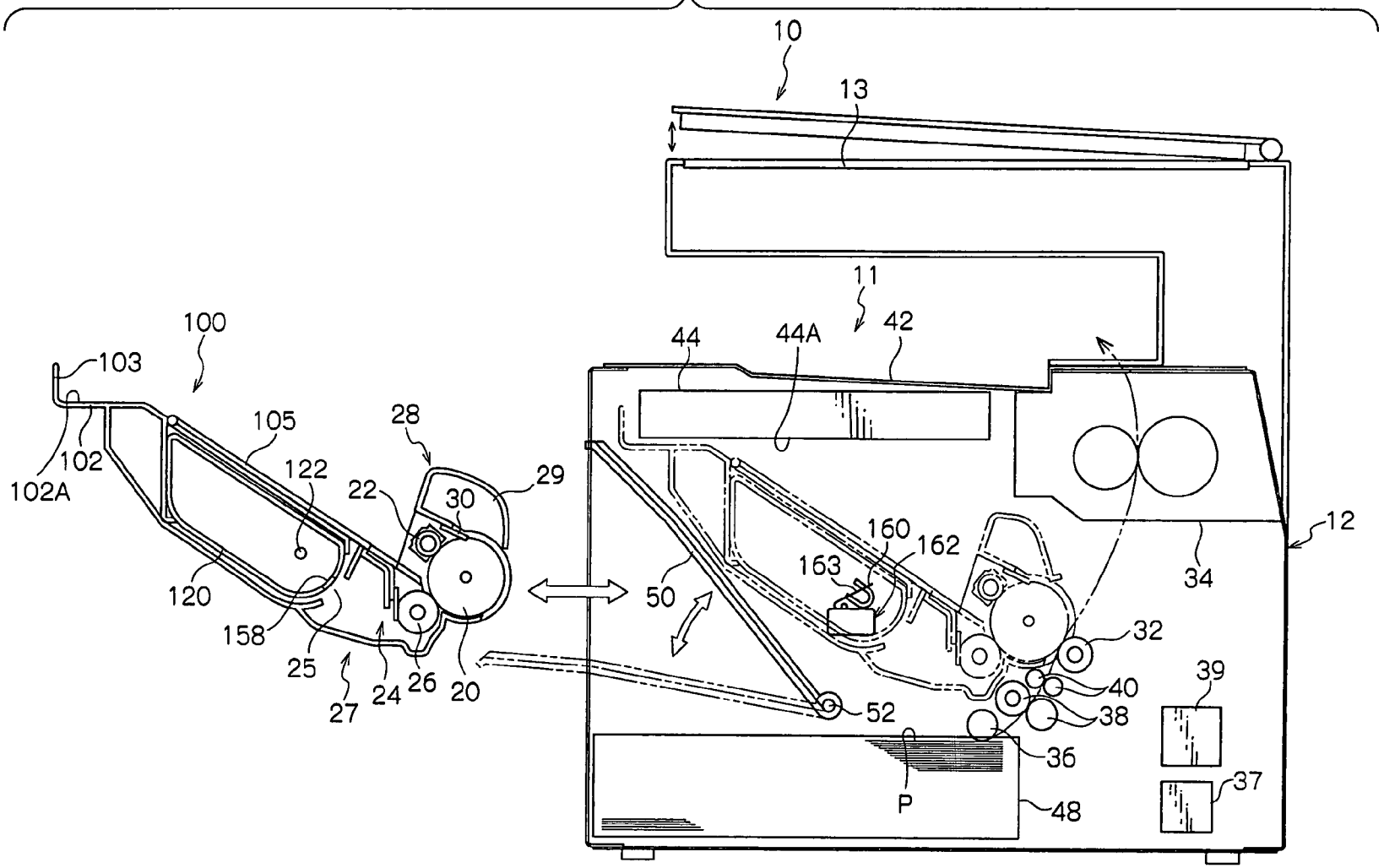
FIG. 20 is a drawing showing a digital copier in which a scanner is disposed above a laser printer relating to the first embodiment of the present invention.

For example, as shown in FIG. 20, even in a digital copier 10 in which a scanner device 13 is disposed above the laser printer 11, the direction of installation/removal of the process cartridge 100 is at the side in the direction of the front surface (the substantially horizontal direction), and therefore, the installation and removal of the process cartridge 100 are not impeded. Namely, the laser printer 11 has wide applicability (extensibility).

A second embodiment of the present invention will be described next. The same reference numerals are applied to members which were described in the first embodiment, and repeat description thereof is omitted.

Figure 9A:
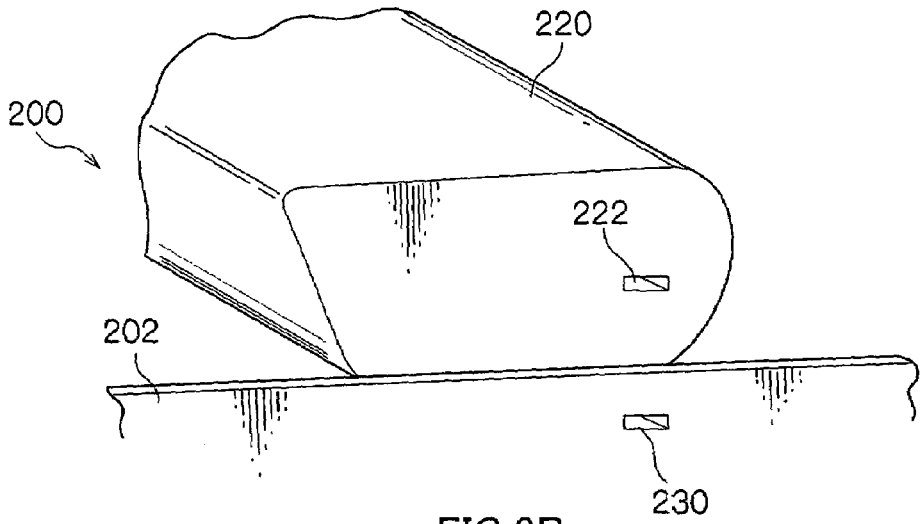
FIGS. 9A, 9B, and 9C are drawings showing, in order, states of installing a toner tank in a process cartridge relating to a second embodiment of the present invention.
Figure 9B:
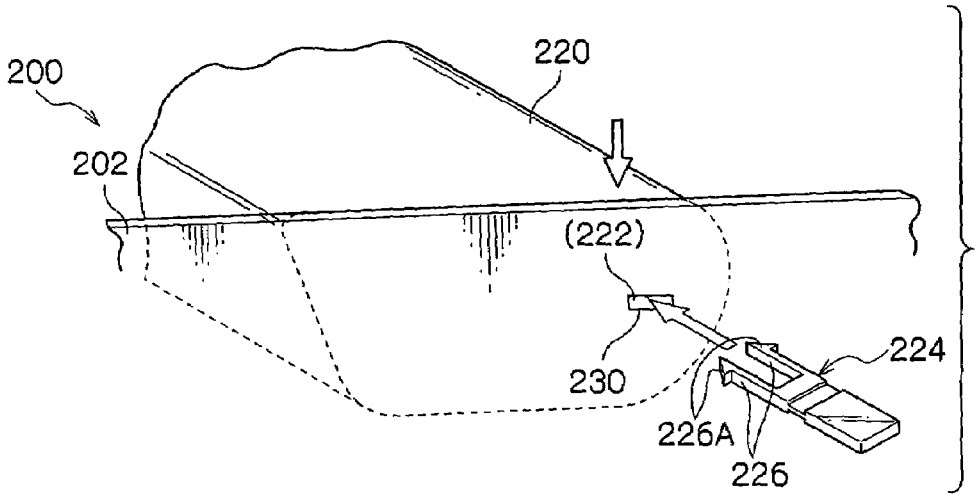
Figure 9C:
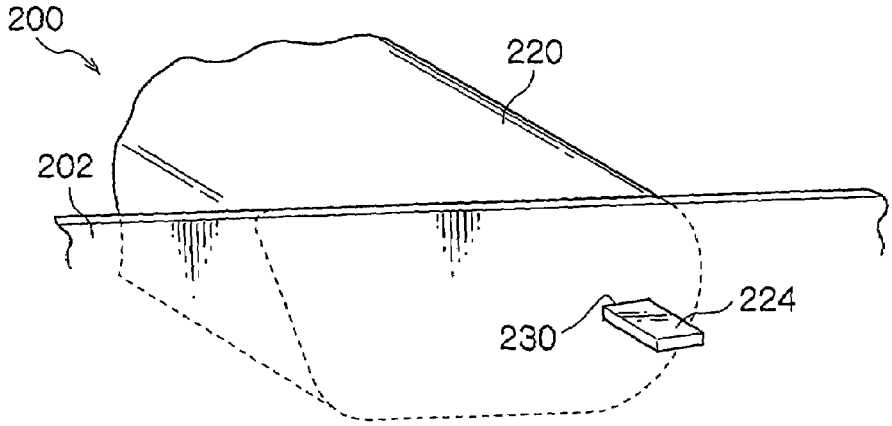

As shown in FIGS. 9A through 9C, a rectangular insertion hole 222 is formed in a side surface of a toner tank 220. A projection hole 230 of the same configuration as the insertion hole 222 is formed in a housing 202 of a process cartridge 200, at a position corresponding to the insertion hole 222. The toner tank 220 is fixed by installing the toner tank 220 in the process cartridge 200 and inserting a projecting plate 224 into both the projection hole 230 and the insertion hole 222.

As shown in FIG. 9B, the distal end portion of the projecting plate 224 (i.e., the end portion thereof in the direction of insertion) is bifurcated into two forked-off portions 226. Head portions 226A of the distal ends of the two forked-off portions 226 are triangular. Further, the width of the head portions 226A is greater than the width of the trunk portion of the projecting plate 224.

The entry opening of the insertion hole 222 is substantially the same size as the width of the trunk portion of the projecting plate 224, and is narrower than the width of the head portions 226A. However, an inner portion (not illustrated) of the insertion hole 222 is wider than the head portions 226A.

When an attempt is made to insert the projecting plate 224 into the projection hole 230 and the insertion hole 222, the head portions 226A abut the entrance of the projection hole 230. However, when the projection plate 224 is inserted further and pushed in, the forked-off portions 226 narrow so as to enter into the projection hole 230 and the insertion hole 222. When the entire head portions 226A are inserted in the insertion hole 222, the forked-off portions 226 widen because the inner portion of the insertion hole 222 is wider than the head portions 226A. Even if an attempt is made to pull the projecting plate 224 out, the head portions 226A catch and the projecting plate 224 cannot be pulled out.

Figure 10A:
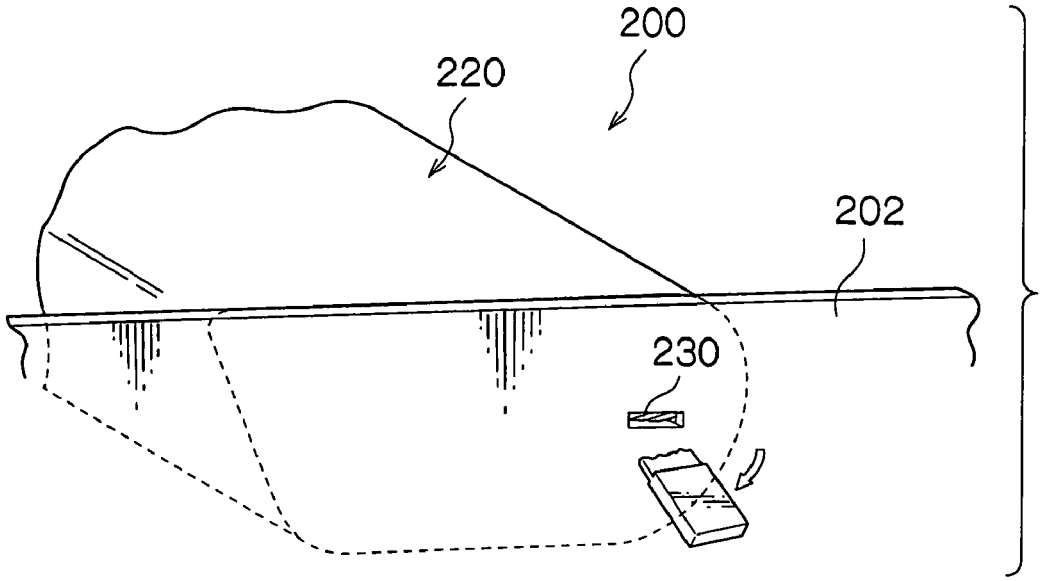
FIGS. 10A and 10B are drawings showing, in order, states of removing the toner tank from the process cartridge relating to the second embodiment of the present invention.
Figure 10B:
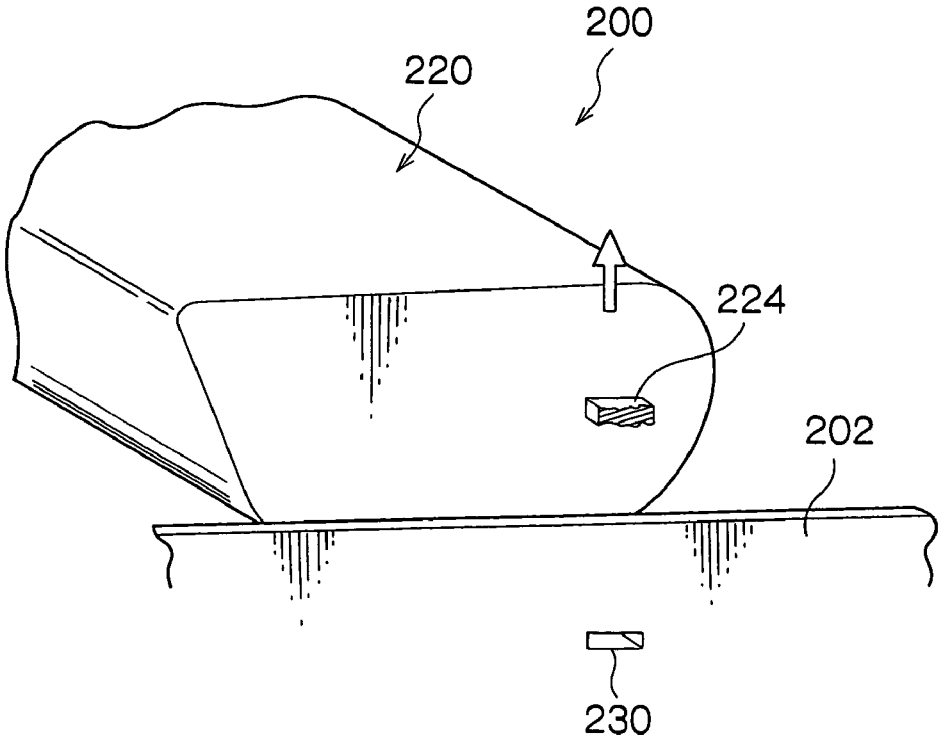

In order to remove the toner tank 220, as shown in FIGS. 10A and 10B, the projecting plate 224 is broken off from the root portions of the forked-off portions 226. Then, the toner tank 220 is removed. Note that the forked-off portions 226 remain in the insertion hole 222 and cannot be removed because the head portions 226A are catching and cannot be pulled out.

Figure 11A:
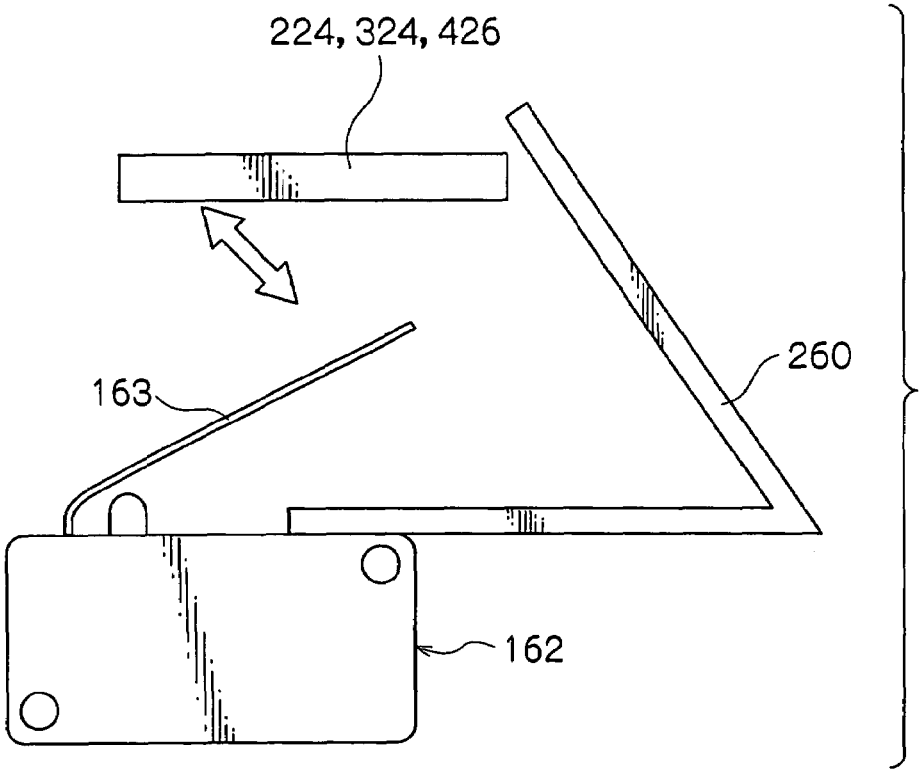
FIGS. 11A and 11B are drawings relating to the second through fourth embodiments of the present invention, where
Figure 11B:
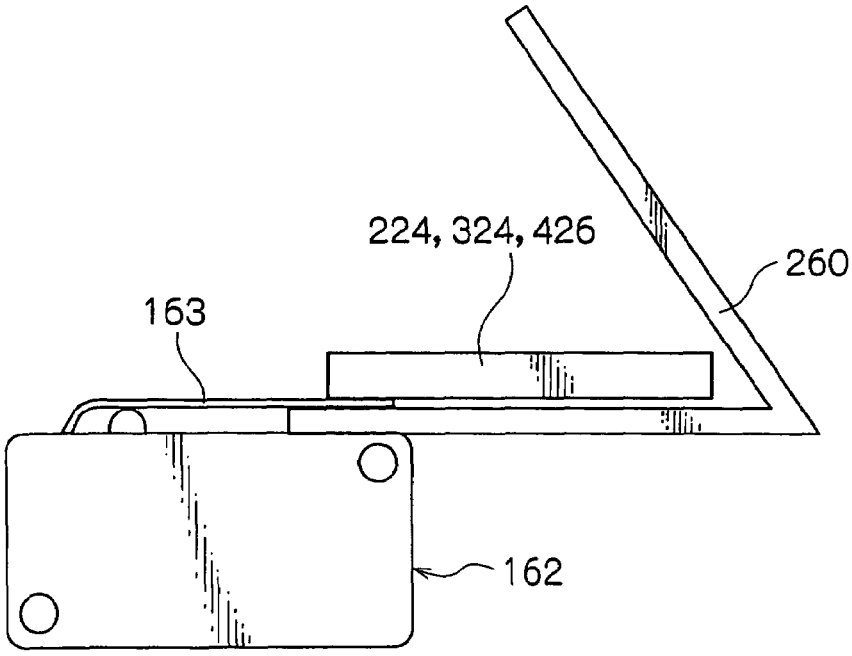

As shown in FIGS. 11A and 11B, the cross-sectional configuration of a positioning portion 260 is triangular, in accordance with the configuration of the projecting plate 224. The positioning portion 160 at the opposite side is U-shaped.

In the same way as in the first embodiment, when the process cartridge 200 is installed, the projecting plate 224 enters into the positioning portion 260 such that the process cartridge 200 is positioned, and the projecting plate 224 pushes the lever 163 of the switch downward and turns the switch 162 on. As shown in FIG. 11A, when the process cartridge 200 is not installed, the switch 162 is off.

Next, operation of the second embodiment will be described.

When the toner becomes a predetermined amount or less, the user replaces only the toner tank 220 of the process cartridge 200.

As described above, the projecting plate 224 cannot be pulled-out from the insertion hole 222 and the projection hole 230 as shown in FIGS. 9A through 9C. Accordingly, as shown in FIG. 10A, the projecting plate 224 is broken off from the root portions of the forked-off portions 226, and as shown in FIG. 10B, the toner tank 220 is removed and a new toner tank 220 is installed. (The way of installing the toner tank was described previously.)

In the same way as in the first embodiment, if the user forgets to install the toner tank 220 in the process cartridge 200, the switch 162 does not sense the projecting plate 224. Accordingly, the laser printer 11 does not operate. Further, because power is not supplied to the light scanning device 44, the laser light LA does not carry out exposure. Moreover, because the process cartridge 200 is not positioned, the laser printer 11 does not operate normally.

As shown in FIGS. 10A and 10B, the projecting plate 224 must be broken in order to remove the toner tank 220. Accordingly, even if a toner tank 220 which had previously been removed is mistakenly installed again in the process cartridge 200 and an attempt is made to insert a new projecting plate 234, the forked-off portions 226 remain in the insertion hole 222, and therefore, the projecting plate 234 cannot be inserted. Accordingly, even if a toner tank 220 which had previously been removed is mistakenly installed again in the process cartridge 200, the toner tank 220 cannot be fixed.

Even if the process cartridge 200 is installed in the laser printer with the toner tank 220 not fixed, because the projecting plate 224 does not project out, the switch 162 does not sense it. Accordingly, the laser printer 11 does not operate, and power is not supplied to the light scanning device 44. Moreover, the process cartridge 200 is not positioned normally.

A third embodiment of the present invention will be described next. The same reference numerals are applied to members which were described in the first and second embodiments, and repeat description thereof is omitted.

Figure 12A:
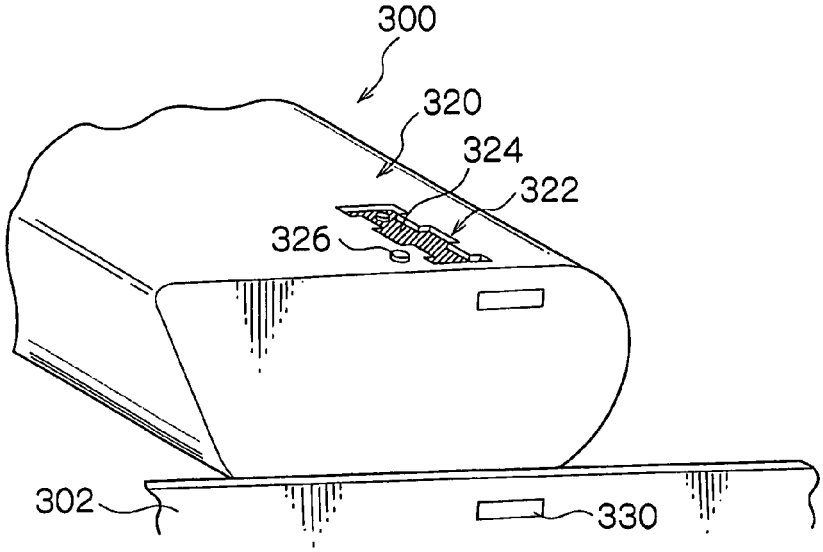
FIGS. 12A, 12B, and 12C are drawings showing, in order, states of installing a toner tank in a process cartridge relating to a third embodiment of the present invention.
Figure 12B:
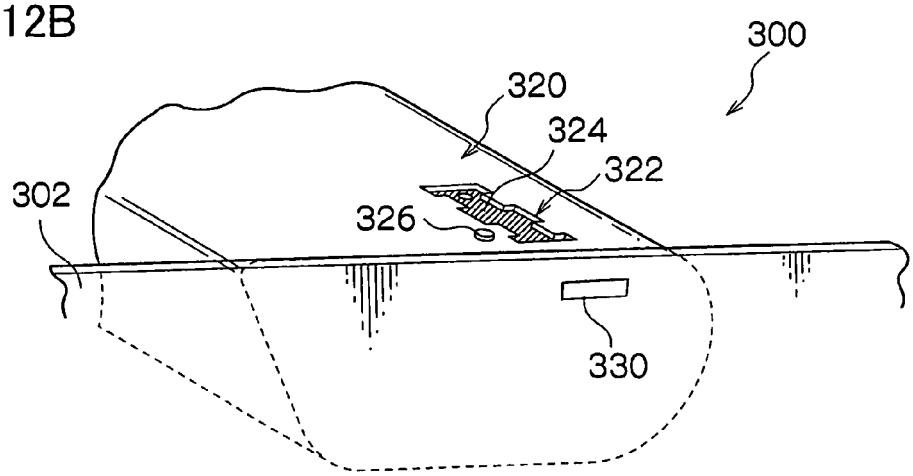
Figure 12C:
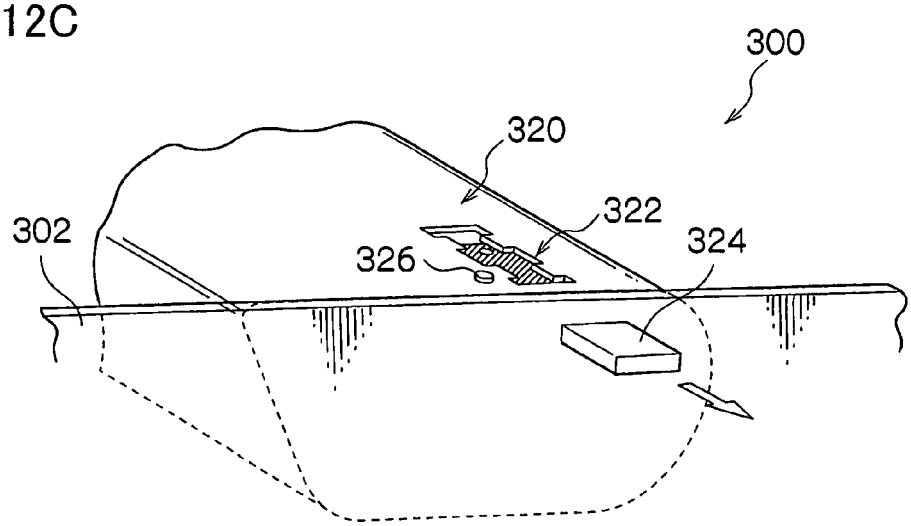

As shown in FIGS. 12A through 12C, a projecting plate accommodating portion 322, in which a projecting plate 324 is slidably accommodated, is provided in the top portion of the toner tank 320.

A projection hole 330 is formed in a housing 302 of a process cartridge 300. When the projecting plate 324 slides, the projecting plate 324 projects out from the projection hole 330. Accordingly, a toner tank 320 is fixed by installing the toner tank 320 in the process cartridge 300 and sliding the projecting plate 324 so as to cause the projecting plate 324 to project out from the projection hole 330.

FIGS. 14A through 14D schematically show the interior structure of the projecting plate accommodating portion 322.

Figure 14A:
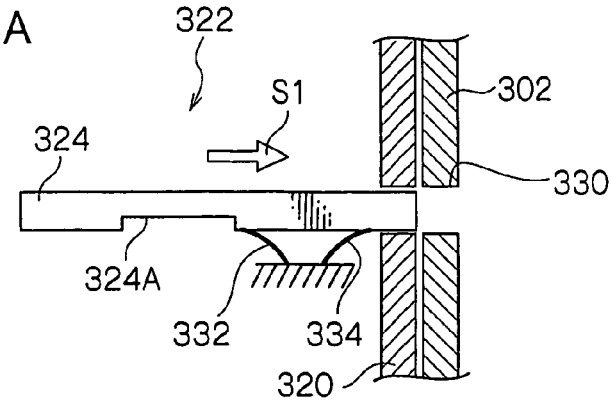
FIGS. 14A, 14B, 14C, and 14D are drawings schematically showing the interior of a projecting plate accommodating portion relating to the third embodiment of the present invention, and show, in order, a sliding operation of a projecting plate.

A groove 324A is formed in the bottom surface of the projecting plate 324. As shown in FIG. 14A, only the bottom ends of a first plate spring 332 and a second plate spring 334 are fixed to the projecting plate accommodating portion 322. The upper end of the first plate spring 332, which upper end is not fixed, tilts in the direction opposite the projection hole 330 (i.e., in the direction of arrow S2 in FIG. 14D). The upper end of the second plate spring 334, which upper end is not fixed, tilts toward the projection hole 330 (i.e., in the direction of arrow S1).

Figure 14B:
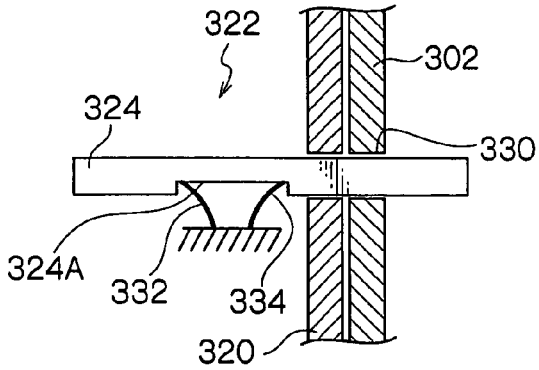

As shown in FIG. 14B, when the projecting plate 324 is slid and projected out from the projection hole 330, the upper ends of the first plate spring 332 and the second plate spring 334 engage with the groove 324A. Accordingly, the projecting plate 324 does not slide either to the left or the right.

Figure 13A:
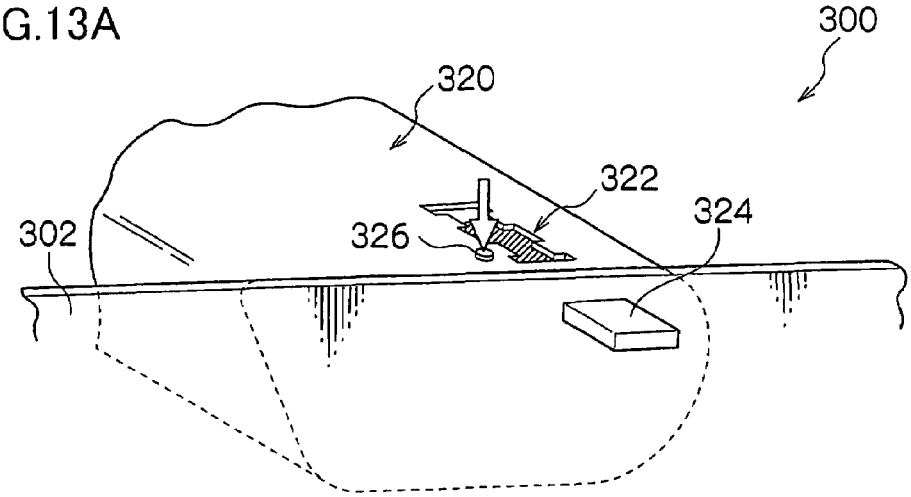
FIGS. 13A, 13B, and 13C are drawings showing, in order, states of removing the toner tank from the process cartridge relating to the third embodiment of the present invention.
Figure 13B:
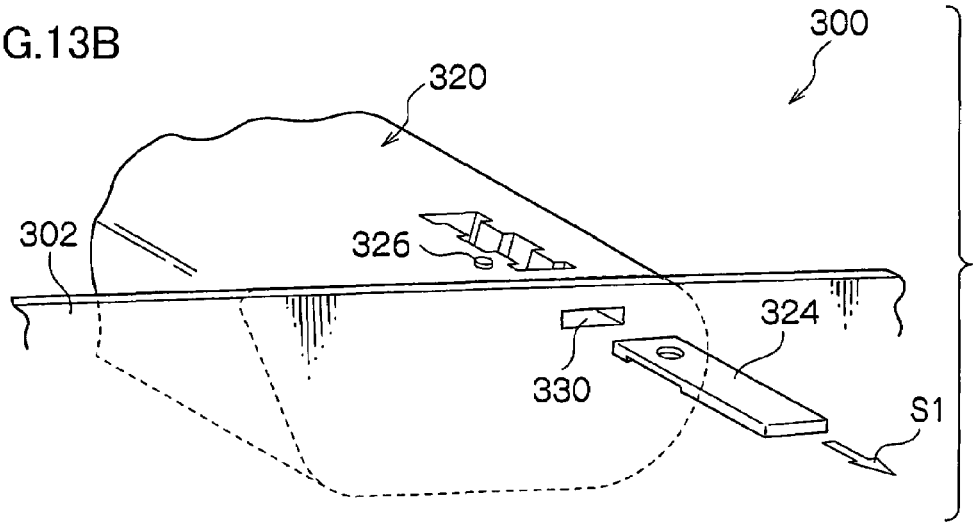
Figure 13C:
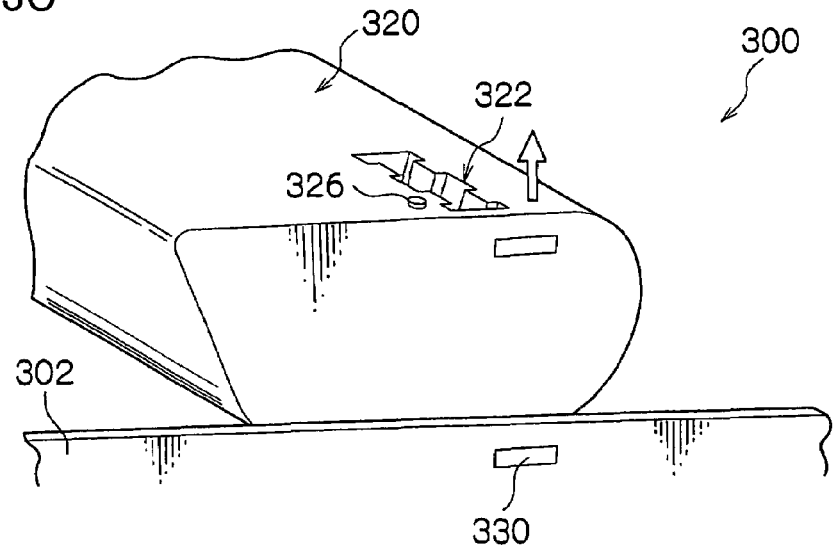
Figure 14C:
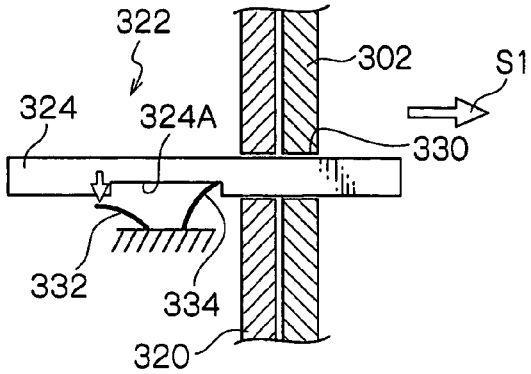

As shown in FIGS. 13A through 13C, a release button 326 is provided at the top surface of the toner tank 320. When the release button 326 is pushed as shown in FIG. 13A, the upper end of the first plate spring 332 is pushed and comes out of the groove 324A as shown in FIG. 14C. Accordingly, as shown in FIG. 14C, the projecting plate 324 becomes able to slide only in the direction of arrow S1. Accordingly, by sliding the projecting plate 324 while pushing the release button 326, the projecting plate 324 is removed. Thus, as shown in FIG. 13C, the toner tank 320 can be removed.

Figure 14D:
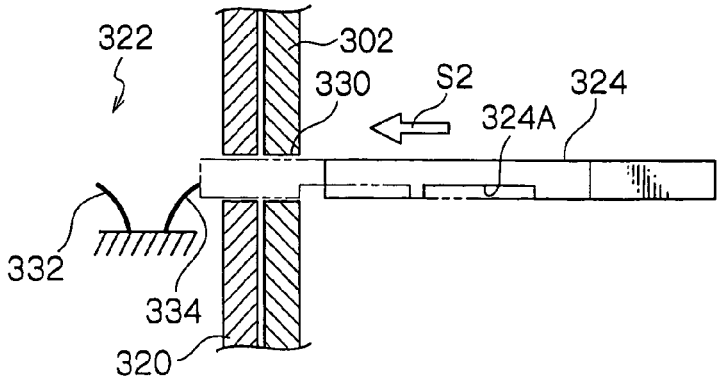

As shown in FIG. 14D, even if an attempt is made to again insert the projecting plate 324 in the direction of arrow S2, the projecting plate 324 abuts the upper end of the second plate spring 334 and cannot be inserted.

In the same way as in the second embodiment, as shown in FIGS. 11 A and 11B, when the process cartridge 300 is installed, the projecting plate 324 enters in the positioning portion 260. The process cartridge 300 is positioned, and the projecting plate 324 pushes the lever 163 of the switch downward such that the switch 162 is turned on.

Next, operation of the third embodiment will be described.

When the toner becomes a predetermined amount or less, the user replaces only the toner tank 320 of the process cartridge 300. As described above and as shown in FIGS. 13A through 13C and FIGS. 14A through 14D, the projecting plate 324 is slid and removed while the release button 326 is pushed. Then, the toner tank 320 is removed, and a new toner tank 320 is installed.

As shown in FIG. 14D, even if an attempt is made to again insert the projecting plate 324, the projecting plate 324 abuts the upper end of the second plate spring 334 and cannot be inserted. Accordingly, even if a toner tank 320 which had previously been removed is mistakenly installed again in the process cartridge 300, the toner tank 320 cannot be fixed. Further, even if the process cartridge 300 is installed in the laser printer main body with the toner tank 320 not fixed, because the projecting plate 324 does not project out, the switch 162 does not sense it. Accordingly, the laser printer does not operate, and power is not supplied to the light scanning device 44. Moreover, the process cartridge 300 is not positioned normally.

A fourth embodiment of the present invention will be described next. The same reference numerals are applied to members which were described in the first embodiment, and repeat description thereof is omitted.

Figure 15A:
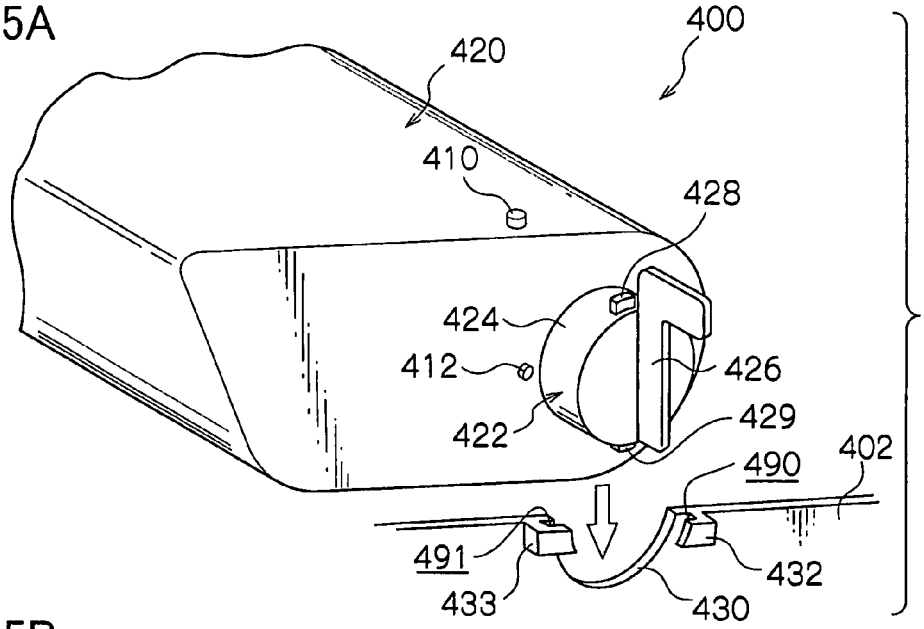
FIGS. 15A, 15B, 15C are drawings showing, in order, states of installing a toner tank in a process cartridge relating to a fourth embodiment of the present invention.
Figure 15B:
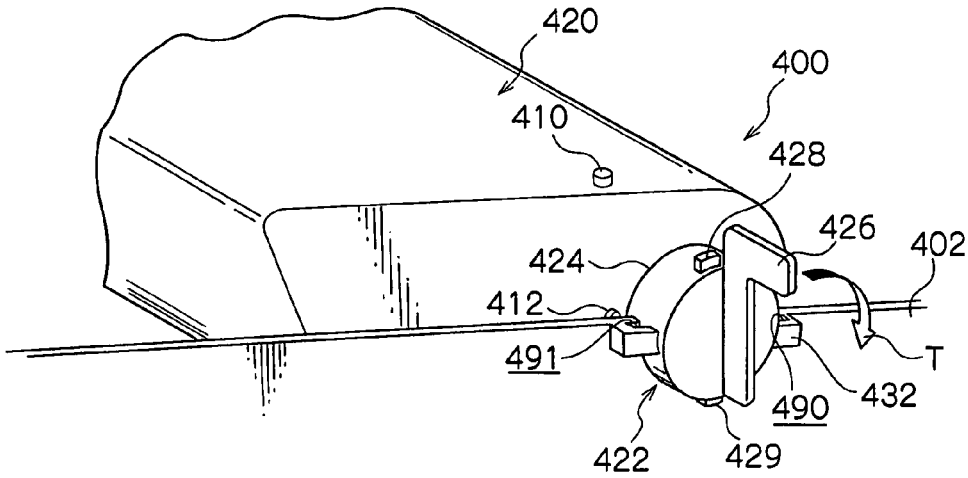
Figure 15C:
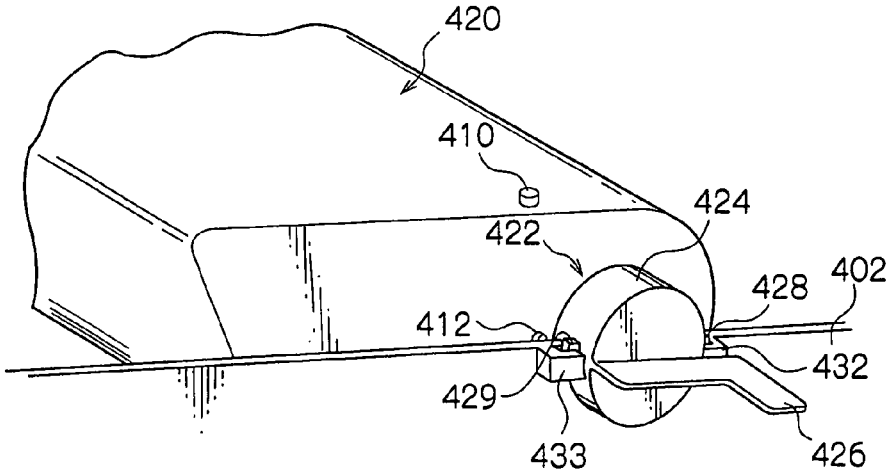

As shown in FIGS. 15A through 15C, a lock portion 422 is provided at the other side surface of a toner tank 420. A rotatable dial portion 424 is provided at the lock portion 422. A lever 426 is provided at the end surface of the dial portion 424. A pair of first convex portions 428, 429 are formed on the outer periphery of the dial portion 424. A second convex portion 414 (see FIG. 18C and FIGS. 19A through 19D) is formed on the outer periphery at a position further toward the toner tank 420 side than the first convex portions 428, 429.

An anchor pin 412 stands erect at the side surface of a housing 402.

Figure 16A:
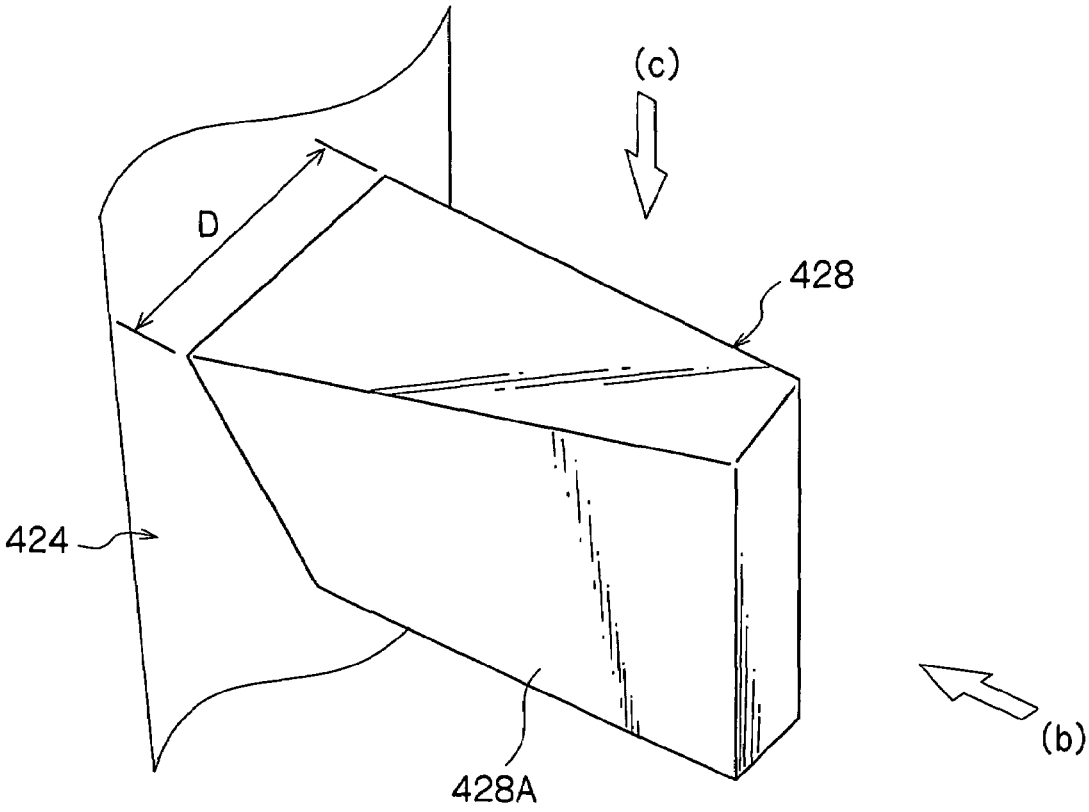
FIGS. 16A, 16B, 16C are perspective views showing a first convex portion relating to the fourth embodiment of the present invention, where
Figure 16C:
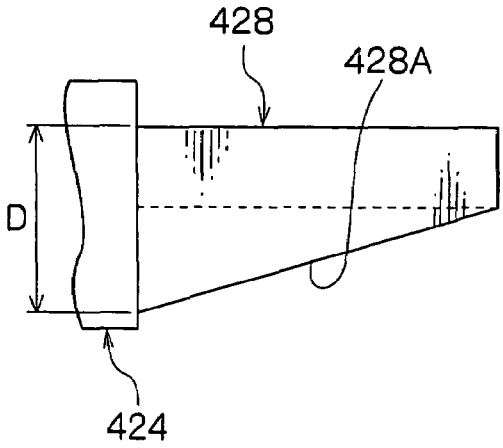
Figure 16B:
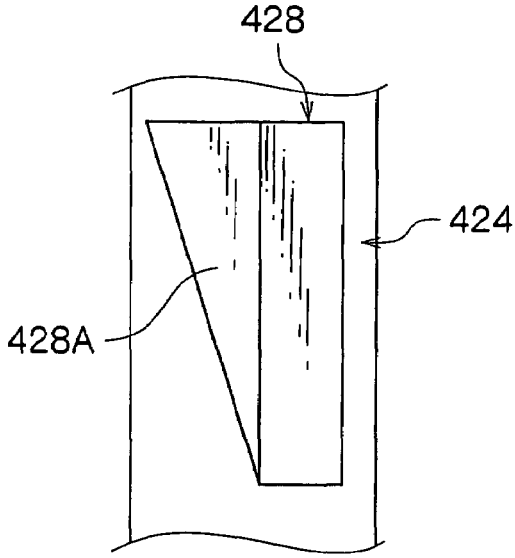

As shown in FIGS. 16A through 16C, a taper surface 428A is formed at the first convex portion 428. The taper surface 428A is formed so as to narrow toward the outer side and so as to narrow toward the lower side. The top surface is trapezoidal, and the bottom floor side is a connecting portion which is connected to the dial portion 424. This lower floor has a maximum width D. Note that only the first convex portion 428 is shown in FIGS. 16A through 16C, but the first convex portion 429 has the same configuration, although the left/right and top/bottom thereof are reversed.

As shown in FIGS. 15A through 15C, a semicircular engaging portion 430, with which the dial portion 424 fits, is formed in the housing 402 of the process cartridge 400. Fixing ribs 432, 433 are formed at the top end portion of the engaging portion 430.

As shown in FIG. 15B, the toner tank 420 is installed in the housing 402 of the process cartridge 400 such that the dial portion 424 fits in the engaging portion 430.

As shown in FIGS. 17A through 17D, gaps 490, 491 between the fixing ribs 432, 433 and the housing 402 are slightly narrower than the maximum widths D of the first convex portions 428, 429. However, the maximum widths of the bottom surface of the first convex portion 428 and the top surface of the first convex portion 429 are wider than the gaps 490, 491.

Figure 17A:
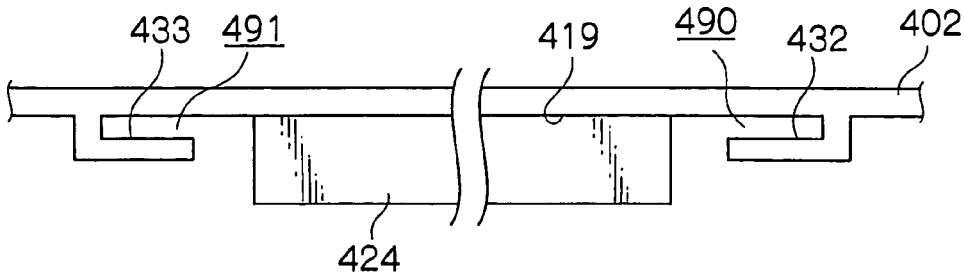
FIG. 17A shows a state before the first convex portions relating to the fourth embodiment of the present invention engage gaps between fixing ribs and a housing.
Figure 17B:
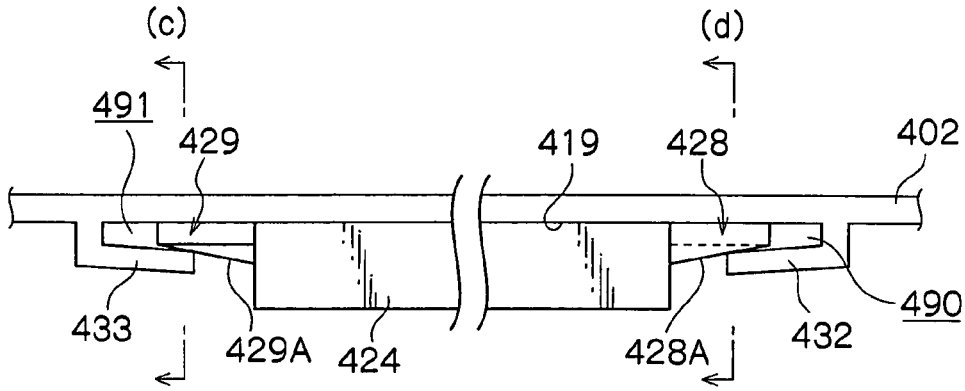
FIG. 17B shows a state after engagement.
Figure 17C:
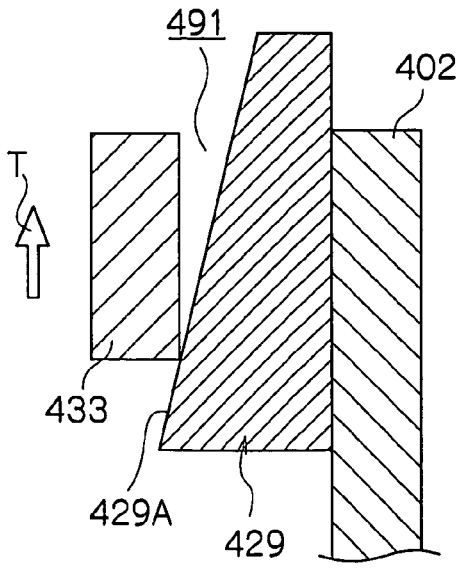
FIG. 17C is cross-section c of FIG. 17B.
Figure 17D:
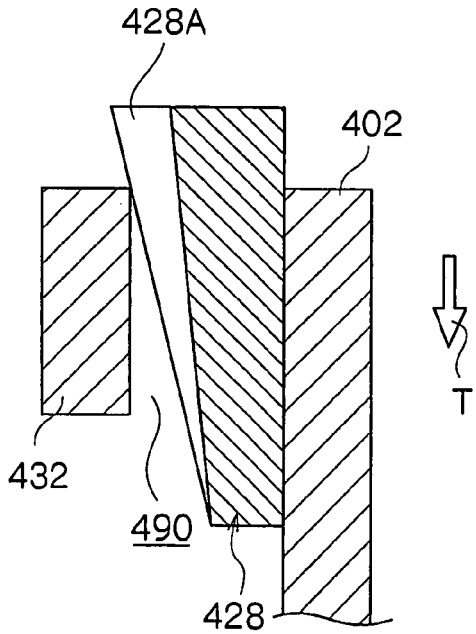
FIG. 17D is cross-section d of FIG. 17B.

As shown in FIG. 15C, when the dial portion 424 is rotated by the lever 426, the fixing ribs 432, 433 spread due to the taper surfaces 428A, 429A of the first convex portions 428, 429, and the first convex portions 428, 429 fit into and are fixed in the gaps 490, 491 between the fixing ribs 432, 433 and the housing 402. Note that the spreading of the fixing ribs 432, 433 in FIG. 17B is depicted in a more exaggerated fashion than is actual.

FIGS. 19A through 19D schematically show the internal structure of the lock portion 422.

A first groove 424A and a second groove 424B are formed in the inner wall of the dial portion 424. Only the bottom ends of a first plate spring 416 and a second plate spring 417 are fixed to a mounting surface 419 of a side wall of the toner tank 420 to which the dial portion 424 is mounted. The upper end of the first plate spring 416, which upper end is not fixed, tilts in the counterclockwise direction which is the direction opposite to the rotating direction (the direction of arrow T). The upper end of the second plate spring 417, which upper end is not fixed, tilts in the clockwise direction which is the rotating direction (the direction of arrow T).

Figure 19A:
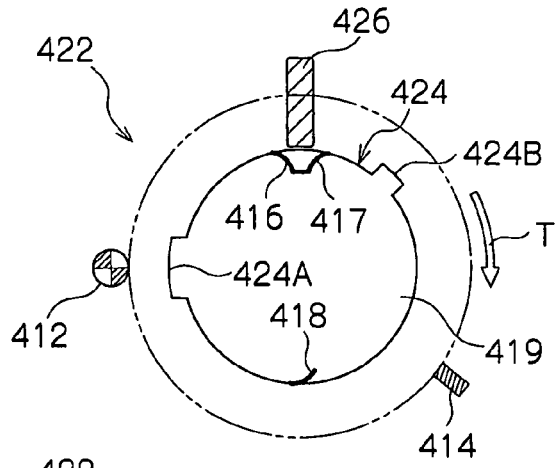
FIGS. 19A, 19B, 19C, and 19D schematically show a lock portion relating to the fourth embodiment of the present invention, and are drawings showing, in order, operation of rotating a dial portion.
Figure 19B:
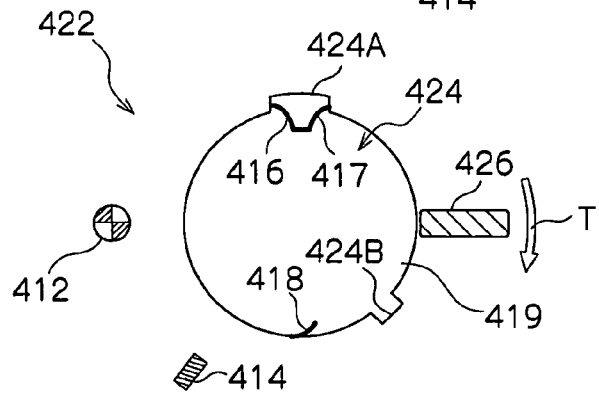
Figure 19C:
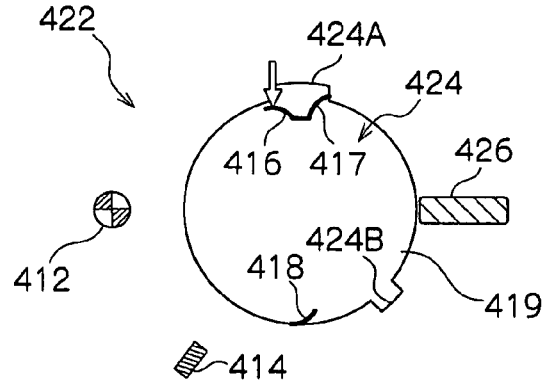
Figure 19D:
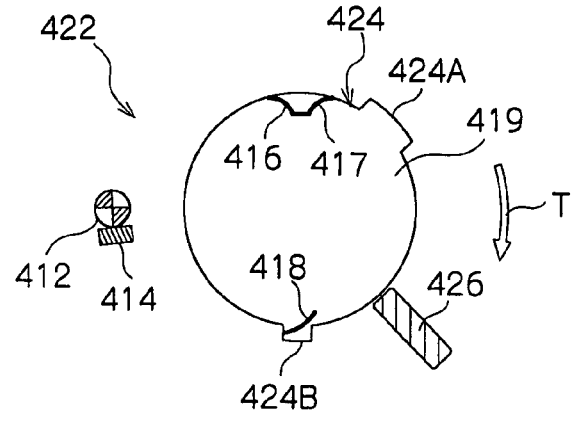

As described above and as shown in FIGS. 15B and 15C, when the dial portion 424 is rotated in the direction of arrow T by the lever 426, as shown in FIGS. 17A through 17D, the first convex portions 428, 429 are fit into the gaps 490, 491 between the fixing ribs 432, 433 and the housing 402. Further, as shown in FIG. 19B, the upper ends of the first plate spring 416 and the second plate spring 417 engage with the first groove 424A. Accordingly, the dial portion 424 cannot rotate in either direction.

Figure 18A:
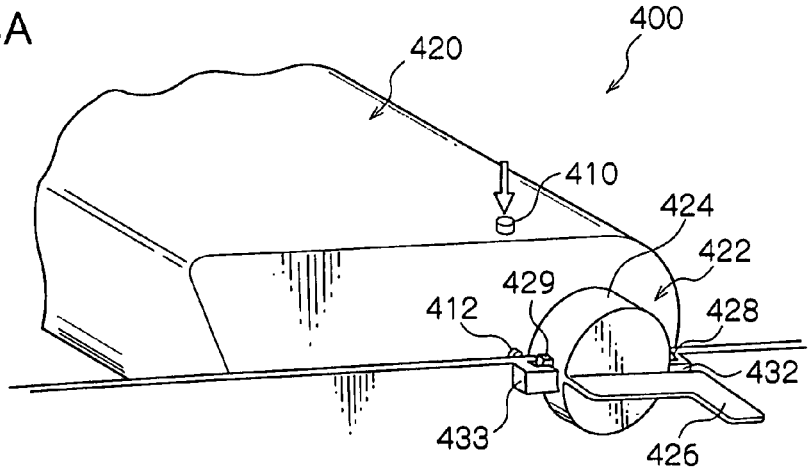
FIGS. 18A, 18B, and 18C are drawings showing, in order, states of removing the toner tank from the process cartridge relating to the fourth embodiment of the present invention.
Figure 18B:
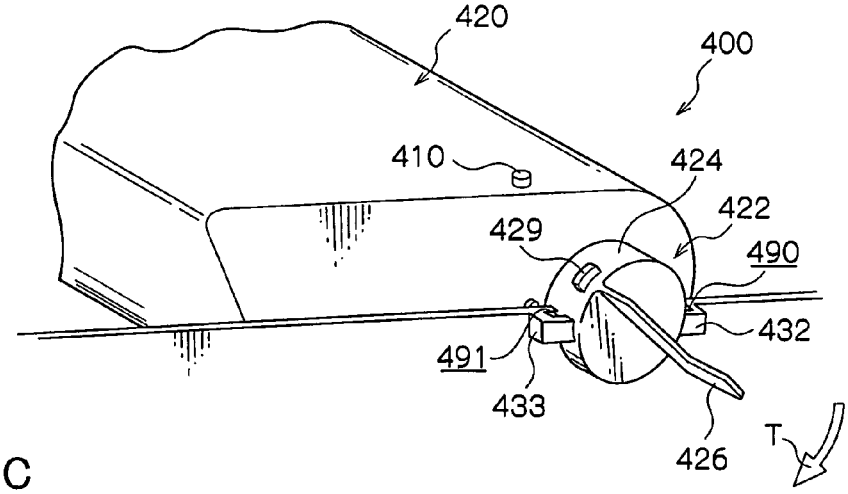
Figure 18C:
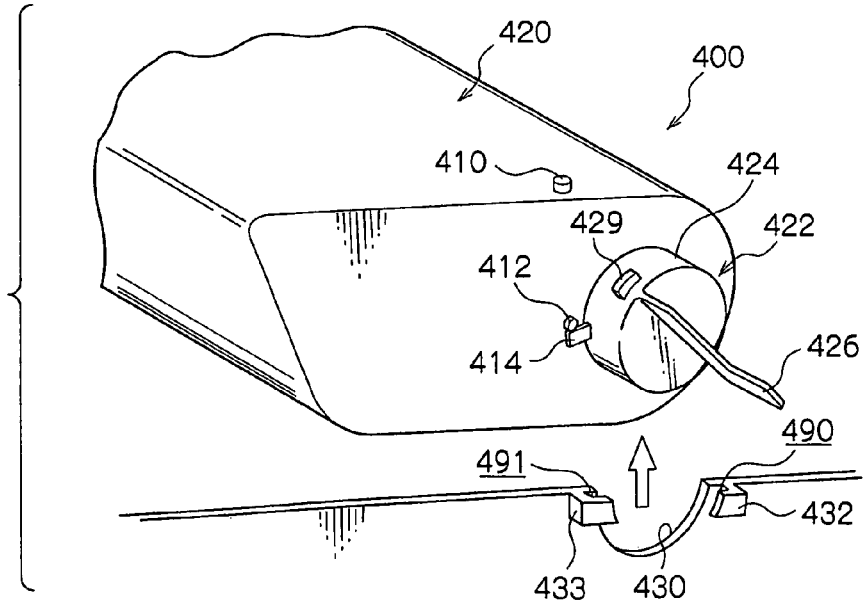

As shown in FIGS. 18A through 18C, a release button 410 is provided at the top portion of the toner tank 420. When the release button 410 is pushed, as shown in FIG. 19B, the upper end of the first plate spring 416 is pushed and comes out of the first groove 424A. Accordingly, the dial portion 424 can rotate only in the direction of arrow T. Thus, while the release button 410 is being pressed, the dial portion 424 is rotated, and the first convex portions 428, 429 come out from the gaps 490, 491 between the fixing ribs 432, 433 and the housing 402 (see FIG. 17B). As can be understood from FIG. 17C, the gaps 490, 491 between the fixing ribs 432, 433 and the housing 402 are slightly more narrow than the maximum widths D of the first convex portions 428, 429. Therefore, even if the dial portion 424 is rotated in the opposite direction (the direction opposite to arrow T), the first convex portions 428, 429 do not enter into the gaps 490, 491.

When the dial portion 424 is rotated further, the second convex portion 414 abuts the anchor pin 412 such that rotation stops, and a third plate spring 418 engages with the second groove 424B such that reverse rotation is prohibited. Then, as shown in FIG. 18C, the toner tank 420 can be removed.

Differently than the first through third embodiments, the lever 152 is not provided at the rotating shaft 154 at the far side of the toner tank 420 (see FIGS. 6A and 6B). However, the dial portion 424 is connected to the rotating shaft 154. When the lever 426 is rotated and the state shown in FIG. 15C is reached, the shutter 156 opens in the same way as in FIGS. 7A through 7C. Namely, the lever 426 also functions as the lever 152 (see FIGS. 6A and 6B) which opens and closes the shutter 156.

In the same way as in the second embodiment, as shown in FIGS. 11A and 11B, when the process cartridge 400 is installed, the lever 426 enters into the positioning portion 260. The process cartridge 400 is positioned, the lever 426 pushes the lever 163 of the switch down, and the switch 162 is turned on.

Next, operation of the fourth embodiment will be described.

When the toner becomes a predetermined amount or less, the user replaces only the toner tank 420 of the process cartridge 400. As described above and as shown in FIGS. 18A through 18C and FIGS. 19A through 19D, while the release button 410 is pressed, the lever 426 is rotated, and the toner tank 420 is removed and replaced with a new toner tank 420.

When the lever 426 is rotated and the state shown in FIG. 15C is reached, the shutter 156 opens in the same way as in FIGS. 7A through 7C. Therefore, the replacement work is simple.

Even if a toner tank 420 which had previously been removed is mistakenly installed again in the process cartridge 400, the toner tank 420 cannot be fixed because the lever 426 does not rotate. Further, even if the process cartridge 400 is installed in the laser printer main body with the toner tank 420 not fixed thereat, because the lever 426 is not at the position shown in FIG. 15C, the switch 162 does not sense the lever 426. Accordingly, the laser printer 11 does not operate, and power is not supplied to the light scanning device 44. Moreover, the process cartridge 400 is not positioned normally.

Note that the present invention is not limited to the above-described embodiments.

For example, the above-described embodiments are developing systems in which the developing agent uses only toner. However, the present invention is not limited to the same. For example, a developing system may be utilized which uses a developing agent in which toner and carrier are mixed together. In the case of a developing system using a developing agent in which toner and carrier are mixed together, a lack of toner causes problems such as the carrier damages the surface of the photosensitive body, or, after the carrier adheres to the surface of the photosensitive body, the carrier is transferred to the recording sheet and carried to the fixing device where it damages the rollers of the fixing device, or the like. However, these problems can be prevented in the present invention.

As described above, in accordance with the present invention, even if a process cartridge, in which a developing agent tank is not installed, is installed, the image forming device does not operate, and therefore, problems caused by the developing agent tank not being installed do not arise.

What is claimed is:

1. An image forming device comprising:

a device main body;

a cartridge attached removably to the device main body, the cartridge having a cartridge housing, a photosensitive body, a developing section for developing a latent image formed on the photosensitive body, and a developing agent tank accommodated in the cartridge housing and for supplying developing agent to the developing section, the developing agent tank comprising an indication portion;

a sensing portion sensing the indication portion; and a permitting portion permitting operation of the image forming device when the sensing portion senses the indication portion, wherein the developing agent tank is configured to be removed from the cartridge.

2. An image forming device comprising:

a device main body;

a cartridge attached removably to the device main body, the cartridge having a cartridge housing, a photosensitive body, a developing section for developing a latent image formed on the photosensitive body, and a developing agent tank accommodated in the cartridge housing and for supplying developing agent to the developing section, the developing agent tank comprising an indication portion;

a sensing portion sensing the indication portion; and a permitting portion permitting operation of the image forming device when the sensing portion senses the indication portion, wherein the indication portion has a projecting portion projecting from the developing agent tank, the projecting portion is movable between a first state for fixing the developing agent tank accommodated in the cartridge, and a second state releasing the fixing so as to permit removal of the developing agent tank, and the sensing portion can sense the projecting portion which is in the first state.

3. The image forming device of claim 2, further comprising a prohibiting portion prohibiting the projecting portion from moving from the second state to the first state.

4. The image forming device of claim 2, wherein the projecting portion can position the cartridge in the device main body.

5. The image forming device of claim 1, further comprising:

a light scanning device which can emit laser light for exposure for forming the latent image; and a current supplying permitting portion permitting supply of current to the light scanning device when the sensing portion senses the indication portion.

6. The image forming device of claim 1, further comprising:

a light scanning device which can emit laser light for exposure for forming the latent image; and a light blocking wall for blocking reflected light of the laser light.

7. The image forming device of claim 1, further comprising a light scanning device which can emit laser light for exposure for forming the latent image, wherein an exposure direction of the laser light is substantially a same direction as a cartridge installing direction.

8. The image forming device of claim 1, further comprising a light scanning device which can emit laser light for exposure for forming the latent image, wherein the light scanning device is disposed above the photosensitive body, and a direction of installing and removing the cartridge is a substantially horizontal direction.

9. The image forming device of claim 3, wherein the developing agent tank has:

a projecting portion accommodating portion slidably accommodating the projecting portion;

a holding portion for holding the projecting portion such that the projecting portion is in the first state in which the projecting portion partially projects out from the projecting portion accommodating portion; and a release portion for releasing the holding such that the projecting portion is in the second state in which the projecting portion is separated from the projecting portion accommodating portion.

10. The image forming device of claim 9, wherein the holding portion has:

a first prohibiting member for prohibiting the projecting portion, which is positioned at a predetermined position, from sliding in one direction; and a second prohibiting member for prohibiting the projecting portion, which is positioned at the predetermined position, from sliding in an opposite direction.

11. The image forming device of claim 9, wherein the cartridge housing has a projection hole through which the projecting portion, which slides from the projecting portion accommodating portion, can pass.

12. The image forming device of claim 3, wherein the developing agent tank has a rotating portion which is integral with the projecting portion and which has a first convex portion and a second convex portion, and the cartridge housing has a fixing portion engaging with the first convex portion in order to fix the developing agent tank which is in the first state.

13. The image forming device of claim 12, wherein the developing tank has an anchor portion anchoring the second convex portion in the second state in which the projecting portion is rotated by a predetermined angle in one direction from the first state.

14. The image forming device of claim 13, wherein the cartridge housing has:

a first prohibiting member engaging with the rotating portion which is in the first state, such that the rotating portion does not rotate in the one direction;

a second prohibiting member engaging with the rotating portion which is in the first state, such that the rotating portion does not rotate in another direction; and a third prohibiting member engaging with the rotating portion which is in the second state, such that the rotating portion does not rotate in the other direction.

15. The image forming device of claim 12, wherein the developing tank has:

a developing agent supply opening for supplying the developing agent to the developing section; and a shutter for opening/closing the developing agent supply opening, the shutter being interlocked with rotation of the rotating portion and opening when the first state arises.

16. An image forming device comprising: a device main body;

a cartridge attached to the device main body and comprising a cartridge housing and a developing agent tank removably attached to the cartridge housing;

wherein, operation of the image forming device is permitted when the developing agent tank is attached to the cartridge housing and is not permitted when the developing agent tank is removed from the cartridge housing.

17. The image forming device of claim 16, wherein the cartridge further comprises a photosensitive body and a developing section for developing a latent image formed on the photosensitive body, and the developing agent tank supplies developing agent to the developing section.

18. The image forming device of claim 16, wherein the cartridge is removably attached to the device main body and operation of the image forming device is not permitted when the cartridge is removed from the device main body.

19. The image forming device of claim 16, wherein the developing agent tank includes an indication portion and the image forming device senses the indicating portion to determine whether the developing agent tank is attached to the cartridge housing.

20. The image forming device of claim 18, wherein the developing agent tank includes an indication portion and the image forming device senses the indicating portion to determine whether the developing agent tank is attached to the cartridge housing.

* * * * *